US006441058B2

(12) United States Patent
Thurber et al.

(10) Patent No.: US 6,441,058 B2
(45) Date of Patent: Aug. 27, 2002

(54) ABRASIVE ARTICLES HAVING ABRASIVE LAYER BOND SYSTEM DERIVED FROM SOLID, DRY-COATED BINDER PRECURSOR PARTICLES HAVING A FUSIBLE, RADIATION CURABLE COMPONENT

(75) Inventors: Ernest L. Thurber, Woodbury; Eric G. Larson, Lake Elmo; Gregg D. Dahlke, St. Paul; Robert J. DeVoe, Oakdale; Alan R. Kirk, Cottage Grove, all of MN (US); Mark R. Meierotto, Hudson, WI (US); Roy Stubbs, Nuneaton (GB)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/761,371

(22) Filed: Jan. 16, 2001

Related U.S. Application Data

(62) Division of application No. 09/071,263, filed on May 1, 1998, now Pat. No. 6,228,133.

(51) Int. Cl.[7] ..... C09D 5/03; C08L 63/00; C08L 75/00; C08L 67/06

(52) U.S. Cl. ..... 522/96; 522/103; 522/107; 522/170; 522/173; 522/174; 522/175; 522/179; 522/181; 522/182

(58) Field of Search ..... 522/103, 182, 522/173, 174, 175, 181, 179, 107, 96

(56) References Cited

U.S. PATENT DOCUMENTS

| | | | |
|---|---|---|---|
| 2,071,549 | A | 2/1937 | Mahlman |
| 2,128,905 | A | 9/1938 | Benner et al. |
| 2,128,907 | A | 9/1938 | Benner et al. |
| 2,958,593 | A | 11/1960 | Hoover et al. |
| 3,018,262 | A | 1/1962 | Schroeder |
| 3,117,099 | A | 1/1964 | Proops et al. |
| 3,464,948 | A | 9/1969 | Russell |
| 3,641,195 | A | 2/1972 | Ball et al. |
| 4,009,224 | A | 2/1977 | Warnken |
| 4,026,705 | A | 5/1977 | Crivello et al. |
| 4,028,393 | A | 6/1977 | Rottloff et al. |
| 4,058,401 | A | 11/1977 | Crivello |
| 4,173,476 | A | 11/1979 | Smith et al. |
| 4,250,053 | A | 2/1981 | Smith |
| 4,256,828 | A | 3/1981 | Smith |
| 4,312,902 | A | 1/1982 | Murase et al. |
| 4,427,481 | A | 1/1984 | Smith et al. |
| 4,517,340 | A | 5/1985 | Read et al. |
| 4,560,579 | A | 12/1985 | Siadat et al. |
| 4,612,209 | A | 9/1986 | Forgo et al. |
| 4,652,275 | A | 3/1987 | Bloecher et al. |
| 4,684,678 | A | 8/1987 | Schultz et al. |
| 4,693,775 | A | 9/1987 | Harrison et al. |
| 4,708,996 | A | 11/1987 | Hoffman et al. |

(List continued on next page.)

FOREIGN PATENT DOCUMENTS

| | | | |
|---|---|---|---|
| DE | 3243383 | A | 5/1984 |
| DE | 3938376 | A1 | 5/1991 |
| DE | 19541923 | A | 5/1997 |

(List continued on next page.)

*Primary Examiner*—Susan W. Berman
(74) *Attorney, Agent, or Firm*—Scott A. Bardell

(57) ABSTRACT

The present invention involves the use of powder coating methods to form coated abrasives. In one embodiment, the powder is in the form of a multiplicity of binder precursor particles comprising a radiation curable component. In other embodiments, the powder comprises at least one metal salt of a fatty acid and optionally an organic component that may be a thermoplastic macromolecule, a radiation curable component, and/or a thermally curable macromolecule. In either embodiment, the powder exists as a solid under the desired dry coating conditions, but is easily melted at relatively low temperatures and then solidified also at reasonably low processing temperatures. The principles of the present invention can be applied to form make coats, size coats, and/or supersize coats, as desired.

16 Claims, 6 Drawing Sheets

U.S. PATENT DOCUMENTS

| | | | | | |
|---|---|---|---|---|---|
| 4,735,632 | A | * | 4/1988 | Oxman et al. | |
| 4,751,138 | A | | 6/1988 | Tumey et al. | |
| 4,789,712 | A | | 12/1988 | Hoffman et al. | |
| 4,799,939 | A | | 1/1989 | Bloecher et al. | |
| 4,850,871 | A | | 7/1989 | Bryan | |
| 4,903,440 | A | | 2/1990 | Larson et al. | |
| 4,920,182 | A | | 4/1990 | Manser et al. | |
| 4,927,431 | A | * | 5/1990 | Buchanan et al. | |
| 4,933,219 | A | | 6/1990 | Sakumoto et al. | |
| 4,991,362 | A | | 2/1991 | Heyer et al. | |
| 4,997,717 | A | | 3/1991 | Rembold et al. | |
| 5,059,701 | A | | 10/1991 | Keipert | |
| 5,071,914 | A | | 12/1991 | Zimmel et al. | |
| 5,089,536 | A | | 2/1992 | Palazzotto | |
| 5,095,046 | A | | 3/1992 | Tse | |
| 5,191,101 | A | | 3/1993 | Palazzotto et al. | |
| 5,215,860 | A | | 6/1993 | McCormick et al. | |
| 5,236,472 | A | | 8/1993 | Kirk et al. | |
| 5,242,980 | A | | 9/1993 | Tse | |
| 5,252,694 | A | | 10/1993 | Willett et al. | |
| 5,294,517 | A | | 3/1994 | McCormick et al. | |
| 5,387,492 | A | | 2/1995 | McCormick et al. | |
| 5,407,978 | A | | 4/1995 | Bymark et al. | |
| 5,436,063 | A | | 7/1995 | Follett et al. | |
| 5,507,850 | A | | 4/1996 | Helmin | |
| 5,523,152 | A | | 6/1996 | Thurber et al. | |
| 5,558,911 | A | | 9/1996 | Blum | |
| 5,681,361 | A | | 10/1997 | Sanders, Jr. | |
| 5,703,198 | A | | 12/1997 | Twigt et al. | |
| 5,704,952 | A | | 1/1998 | Law et al. | |
| 5,709,948 | A | | 1/1998 | Perez et al. | |
| 5,922,473 | A | * | 7/1999 | Muthiah et al. | 427/180 |
| 6,005,017 | A | * | 12/1999 | Daly et al. | 522/107 |

FOREIGN PATENT DOCUMENTS

| | | | |
|---|---|---|---|
| EP | 0 209 859 | A2 | 1/1987 |
| EP | 0 281 354 | A2 | 9/1988 |
| EP | 0 289 632 | A1 | 11/1988 |
| EP | 0 396 150 | A2 | 11/1990 |
| EP | 0 447 115 | A1 | 9/1991 |
| EP | 0 486 308 | A2 | 5/1992 |
| EP | 0 500 009 | A1 | 8/1992 |
| EP | 0 560 018 | A1 | 9/1993 |
| EP | 0 620 259 | A2 | 10/1994 |
| EP | 0 654 323 | A1 | 5/1995 |
| EP | 0 721 975 | A1 | 7/1996 |
| EP | 0 747 170 | A2 | 12/1996 |
| EP | 0 819 747 | A1 | 1/1998 |
| GB | 2 091 736 | A | 8/1982 |
| GB | 2 138 008 | A | 10/1984 |
| JP | 53-042280 | | 4/1978 |
| JP | 56-122823 | | 9/1981 |
| JP | 57-25379 | | 2/1982 |
| JP | 60-137980 | | 7/1985 |
| JP | 60-228527 | | 11/1985 |
| JP | 63-144964 | | 6/1988 |
| JP | 10-98660 | | 4/1989 |
| JP | 52-75842 | | 10/1993 |
| JP | 8-85780 | | 4/1996 |
| JP | 9-176599 | | 7/1997 |
| JP | 9-176600 | | 7/1997 |
| JP | 9-183957 | | 7/1997 |
| JP | 9-235390 | | 9/1997 |
| SU | 1183519 | | 10/1985 |
| WO | WO 92/20754 | | 11/1992 |
| WO | WO 93/11200 | | 6/1993 |
| WO | WO 93/23487 | | 11/1993 |
| WO | WO 97/12929 | | 4/1997 |
| WO | WO 97/25185 | | 7/1997 |
| WO | WO 97/42004 | | 11/1997 |
| WO | WO 98/12021 | | 3/1998 |

* cited by examiner

ABRASIVE ARTICLES HAVING ABRASIVE LAYER BOND SYSTEM DERIVED FROM SOLID, DRY-COATED BINDER PRECURSOR PARTICLES HAVING A FUSIBLE, RADIATION CURABLE COMPONENT

This application is a divisional application of U.S. application Ser. No. 09/071,263, filed May 1, 1998, now U.S. Pat. No. 6,228,133, issued May 8, 2001.

FIELD OF THE INVENTION

This invention is in the field of abrasive articles. More specifically, this invention relates to abrasive articles in which a powder of fusible particles is dry coated, liquefied, and then cured to form at least a portion of the bond system of the abrasive article.

BACKGROUND OF THE INVENTION

Coated abrasive articles generally comprise a backing to which a multiplicity of abrasive particles are bonded by a suitable bond system. A common type of bond system includes a make coat, a size coat, and optionally a supersize coat. The make coat includes a tough, resilient polymer binder that adheres the abrasive particles to the backing. The size coat, also including a tough resilient polymer binder that may be the same or different from the make coat binder, is applied over the make coat to reinforce the particles. The supersize coat, including one or more antiloading ingredients or perhaps grinding aids, may then be applied over the size coat if desired.

In a conventional manufacturing process, the ingredients that are used to form the make coat are dispersed or dissolved, as the case may be, in a sufficient amount of a solvent, which may be aqueous or nonaqueous, to provide the make coat formulation with a coatable viscosity. The fluid formulation is then coated onto the backing, after which the abrasive particles are applied to the make coat formulation. The make coat formulation is then dried to remove the solvent and at least partially cured. The ingredients that are used to form the size coat are also dispersed in a solvent, and the resultant fluid formulation is then applied over the make coat and abrasive particles, dried and cured. A similar technique is then used to apply the supersize coat over the size coat.

The conventional manufacturing process has some drawbacks, however, because all of the coating formulations are solvent-based. Typical make and size coat formulations may include 10 to 50 weight percent of solvent. Supersize coating formulations, in particular, require even more solvent in order to form useful coatings having the desired coating weight and viscosity. Solvents, however, can be expensive to purchase and/or to handle properly. Solvents also must be removed from the coatings, involving substantial drying costs in terms of capital equipment, energy costs, and cycle time. There are also further costs and environmental concerns associated with solvent recovery or disposal. Solvent-based coating formulations also typically require coating methods involving contact with underlying layers at the time of coating. Such contact can disrupt the orientation of the coated abrasive particles, adversely affecting abrading performance.

Not surprisingly, solventless manufacturing techniques have been investigated. One promising approach involves powder coating techniques in which a coating is formed by dry coating a powder of extremely fine, curable binder particles onto a suitable backing, melting the coated powder so that the particles fuse together to form a uniform melt layer, and then curing the melt layer to form a solid, thermoset, binder matrix. For example, PCT patent publication WO 97/25185 describes forming a binder for abrasive particles from dry powders. The dry powders comprise thermally curable phenolic resins that are dry coated onto a suitable backing. After coating, the particles are melted. Abrasive particles are then applied to the melted formulation. The melted formulation is then thermally cured to form a solid, make coat binder matrix. A size coat may be applied in the same way. Significantly, the make and size coats are formed without any solvent, and the size coat powder may be deposited without contacting, and hence disrupting, the underlying abrasive particles.

Notwithstanding the advantages offered by powder coating techniques described in PCT patent publication WO 97/25185, the powders described in this document incorporate resins that are thermally cured. The use of such resins poses substantial challenges during manufacture. Thermally cured resins generally tend to be highly viscous at reasonable processing temperatures, and thus are difficult to get to flow well. This makes it somewhat challenging to cause the binder particles to melt and fuse together in a uniform manner. The thermally curable resins also typically require relatively high temperatures to achieve curing. This limits the kinds of materials that can be incorporated into an abrasive article. In particular, many kinds of otherwise desirable backing materials could be damaged or degraded upon exposure to the temperatures required for curing. It is also difficult to control the start and rate of thermal curing. Generally, thermal curing begins as soon as heat is applied to melt the powder particles. As a consequence, the cure reaction may proceed too far before the powder particles are adequately fused. Further, the resultant bond between the cured binder and the adhesive particles may end up being weaker than is desired.

Accordingly, there is still a need for a solventless manufacturing technique for making abrasive articles that avoids disrupting abrasive particle orientation as the various component layers of the abrasive bond system are formed.

SUMMARY OF THE INVENTION

The present invention involves the use of powder coating methods to form coated abrasives. In one embodiment, the powder is in the form of a multiplicity of binder precursor particles comprising a radiation curable component. In other embodiments, the powder comprises at least one metal salt of a fatty acid and optionally an organic component that may be a thermoplastic macromolecule, a radiation curable component, and/or a thermally curable macromolecule. In either embodiment, the powder exists as a solid under the desired dry coating conditions, but is easily melted at relatively low temperatures and then solidified also at reasonably low processing temperatures. The principles of the present invention can be applied to form make coats, size coats, and/or supersize coats, as desired.

The present invention offers several advantages. Firstly, because melting and curing occur at relatively low temperatures, abrasive articles prepared in accordance with the present invention can be used with a wider range of other components, for example, backing materials, that otherwise would be damaged at higher temperatures. The ability to use lower processing temperatures also means that the present invention has lower energy demands, making the invention more efficient and economical in terms of energy costs. Additionally, the powder coatings can be applied at 100% solids with no solvent whatsoever. Therefore, emission controls, solvent handling procedures, solvent drying, solvent recovery, solvent disposal, drying ovens, energy costs associated with solvents, and the significant costs thereof, are entirely avoided. Powder coating is a noncontact coating method. Unlike many solvent coating techniques, for example, roll coating or the like, powder coating methods are noncontact and, therefore, avoid the kind of coating contact that might otherwise disrupt coated abrasive particles. This advantage is most noticeable when applying size and supersize coats over underlying make coat and abrasive particles. Powder coating methods are versatile and can be applied to a broad range of materials.

The use of dry powder particles comprising a radiation curable component and/or a metal salt of a fatty acid is particularly advantageous in that excellent control is provided over the curing process. Specifically, one can precisely control not only when cure begins, but the rate of cure as well. Thus, the premature crosslinking problems associated with conventional thermosetting powders is avoided. The result is that a binder derived from binder particles and/or powders of the present invention tends to bond more strongly to abrasive particles and is more consistently fully fused prior to curing, making manufacture much easier. As another advantage, the binder particles of the present invention comprising a radiation curable component can be formed using low molecular weight, radiation curable materials that have relatively low viscosity when melted, providing much better flow and fusing characteristics than thermally curable, resinous counterparts.

In one aspect, the present invention relates to an abrasive article comprising a plurality of abrasive particles incorporated into a bond system, wherein at least a portion of the bond system comprises a cured binder matrix derived from ingredients comprising a plurality of solid, binder precursor particles, said binder precursor particles comprising a radiation curable component that is fluidly flowable at a temperature in the range from about 35° C. to about 180° C.

In another aspect, the present invention relates to a method of forming an abrasive article, comprising the steps of (a) incorporating a plurality of abrasive particles into a bond system; and (b) deriving at least a portion of the bond system from a plurality of solid, binder precursor particles, said binder precursor particles comprising a radiation curable component that is fluidly flowable at a temperature in the range from about 35° C. to about 180° C.

In still yet another aspect, the present invention provides a powder, comprising a radiation curable component that is a solid at temperatures below about 35° C. and is fluidly flowable at a temperature in the range from about 35° C. to about 180° C.

The present invention also provides a fusible powder, comprising 100 parts by weight of a metal salt of a fatty acid and 0 to 35 parts by weight of a fusible organic component.

The present invention also relates to a method of forming a supersize coating on an underlying abrasive layer of an abrasive article. A fusible powder is dry coated onto the abrasive layer, wherein the fusible powder comprises at least one metal salt of a fatty acid. The fusible powder is liquefied to form a supersize melt layer. The supersize melt layer is solidified, whereby the supersize coating is formed.

As used herein, the term "cured binder matrix" refers to a matrix comprising a crosslinked, polymer network in which chemical linkages exist between polymer chains. A preferred cured binder matrix is generally insoluble in solvents in which the corresponding, crosslinkable binder precursor(s) is readily soluble. The term "binder precursor" refers to monomeric, oligomeric, and/or polymeric materials having pendant functionality allowing the precursors to be crosslinked to form the corresponding cured binder matrix.

If desired, the cured binder matrix of the present invention may be in the form of an interpenetrating polymer network (IPN) in which the binder matrix includes separately crosslinked, but entangled networks of polymer chains. As another option, the cured binder matrix may be in the form of a semi-IPN comprising uncrosslinked components, for example, thermoplastic oligomers or polymers that generally do not participate in crosslinking reactions, but nonetheless are entangled in the network of crosslinked polymer chains.

As used herein, the term "macromolecule" shall refer to an oligomer, a polymer, and combinations thereof.

BRIEF DESCRIPTION OF THE DRAWINGS

The above mentioned and other advantages of the present invention, and the manner of attaining them, will become more apparent and the invention itself will be better understood by reference to the following description of the embodiments of the invention taken in conjunction with the accompanying drawings, wherein.

DETAILED DESCRIPTION OF THE PRESENTLY PREFERRED EMBODIMENTS

Figure 1:
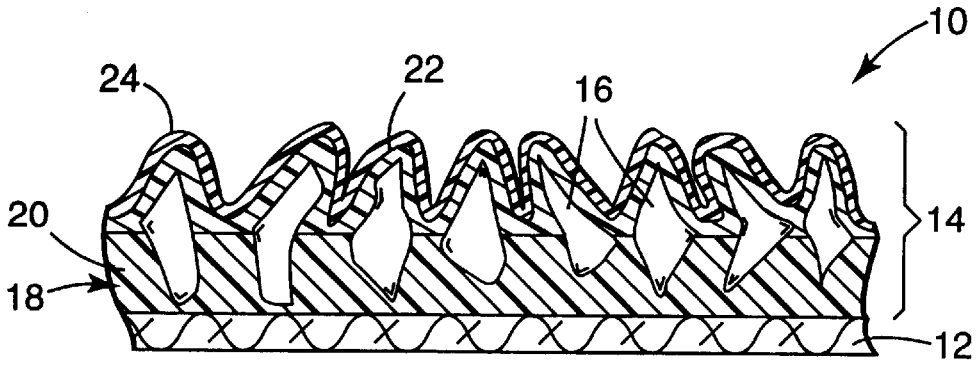
FIG. 1 is a sectional side view of a coated abrasive article according to one embodiment of the present invention.

The radiation curable, fusible binder precursor particles of the present invention may be incorporated into a wide range of different kinds of abrasive articles with beneficial results. For purposes of illustration, the radiation curable, fusible binder precursor particles will be described with respect to the particular flexible, coated abrasive article 10 illustrated in FIG. 1. The embodiments of the present invention described in connection with FIG. 1 are not intended to be exhaustive or to limit the invention to the precise forms disclosed in the following detailed description. Rather the embodiments are chosen and described so that others skilled in the art may appreciate and understand the principles and practices of the present invention.

Abrasive article 10 generally includes backing 12 and abrasive layer 14 bonded to backing 12. Backing 12 may be any suitable backing and typically may be comprised of paper, vulcanized rubber, a polymeric film (primed or unprimed), a woven or nonwoven fibrous material, composites of these, and the like. Backings made from paper typically may have a basis weight in the range from 25 $g/m^2$ to 300 $g/m^2$ or more. Backings made from paper or fibrous materials optionally may be treated with a presize, backsize, and/or saturant coating in accordance with conventional practices. Specific materials suitable for use as backing 12 are well known in the art and have been described, for example, in U.S. Pat. Nos. 5,436,063; 4,991,362; and 2,958,593, incorporated herein by reference.

Abrasive coating 14 includes a plurality of abrasive particles 16 functionally distributed in bond system 18 generally comprising make coat 20, size coat 22, and optional supersize coat 24. Abrasive particles 16 may comprise any suitable abrasive material or combination of materials having abrading capabilities. Abrasive particles 16 preferably comprise at least one material having a Mohs hardness of at least about 8, more preferably at least about 9. Examples of such materials include fused aluminum oxide, heat treated aluminum oxide, white fused aluminum oxide, black silicon carbide, green silicon carbide, titanium diboride, boron carbide, tungsten carbide, titanium carbide, diamond, silica, iron oxide, chromia, ceria, zirconia, titania, silicates, tin oxide, cubic boron nitride, garnet, fused alumina zirconia, sol gel abrasive particles, combinations of these, and the like. As an option, abrasive particles 16 may include a surface coating to enhance the performance of the particles in accordance with conventional practices. In some instances, the surface coating can be formed from a material, such as a silane coupling agent, that increases adhesion between abrasive particles 16 and the binders used in make coat 20, size coat 22, and/or supersize coat 24.

Abrasive particles 16 can be present in any suitable size(s) and shape(s). For example, with respect to size, preferred abrasive particles 16 typically have an average size in the range from about 0.1 micrometers to 2500 micrometers, more preferably from about 1 micrometer to 1300 micrometers. Abrasive particles 16 may also have any shape suitable for carrying out abrading operations. Examples of such shapes include rods, triangles, pyramids, cones, solid spheres, hollow spheres, combinations of these, and the like. Abrasive particles 16 may be present in substantially nonagglomerated form or, alternatively, may be in the form of abrasive agglomerates in which individual particles are adhered together. Examples of abrasive agglomerates are described in U.S. Pat. No. 4,652,275 and U.S. Pat. No. 4,799,939, which patents are incorporated herein by reference.

Make coat 20 helps adhere abrasive particles 16 to backing 12. Size coat 22 is applied over make coat 20 and abrasive particles 16 in order to reinforce particles 16. Optional supersize coat 24 may be included over size coat 22 in order to prevent or reduce the accumulation of swarf (the material abraded from a workpiece) among abrasive particles 16 during abrading operations. Swarf accumulation might otherwise dramatically reduce the cutting ability of abrasive article 10 over time. Alternatively, supersize coat 24 may also be included over size coat 22 in order to incorporate grinding aids into abrasive article 10. Supersize coatings are further described in European Patent Publication No. 486, 308, which is incorporated herein by reference.

In the practice of the present invention, at least portions of one or more of make coat 20, size coat 22, and/or supersize coat 24 constituting bond system 18 comprise a cured binder matrix derived from the binder precursor particles of the present invention. The binder precursor particles of the present invention generally include a radiation curable component that may be formed from any one or more radiation curable, fusible materials that can be dry coated in particulate form, then liquefied to convert the precursor material into a fluid, melt layer, and then cured by exposure to a suitable source of curing energy to convert the fluid melt layer into a thermoset, solid, cured binder matrix component of bond system 18.

In the practice of the present invention, "radiation curable" refers to functionality directly or indirectly pendant from a monomer, oligomer, or polymer backbone (as the case may be) that participate in crosslinking reactions upon exposure to a suitable source of curing energy. Such functionality generally includes not only groups that crosslink via a cationic mechanism upon radiation exposure but also groups that crosslink via a free radical mechanism. Representative examples of radiation crosslinkable groups suitable in the practice of the present invention include epoxy groups, (meth)acrylate groups, olefinic carbon-carbon double bonds, allyloxy groups, alpha-methyl styrene groups, (meth)acrylamide groups, cyanate ester groups, vinyl ethers groups, combinations of these, and the like.

The energy source used for achieving crosslinking of the radiation curable functionality may be actinic (for example, radiation having a wavelength in the ultraviolet or visible region of the spectrum), accelerated particles (for example, electron beam radiation), thermal (for example, heat or infrared radiation), or the like. Preferably, the energy is actinic radiation or accelerated particles, because such energy provides excellent control over the initiation and rate of crosslinking. Additionally, actinic radiation and accelerated particles can be used for curing at relatively low temperatures. This avoids degrading components of abrasive article 10 that might be sensitive to the relatively high temperatures that might be required to initiate crosslinking of the radiation curable groups when using thermal curing techniques. Suitable sources of actinic radiation include a mercury lamp, a xenon lamp, a carbon arc lamp, a tungsten filament lamp, sunlight, and the like. Ultraviolet radiation, especially from a medium pressure mercury arc lamp, is most preferred.

The amount of curing energy to be used for curing depends upon a number of factors, such as the amount and the type of reactants involved, the energy source, web speed, the distance from the energy source, and the thickness of the bond layer to be cured. Generally, the rate of curing tends to increase with increased energy intensity. The rate of curing also may tend to increase with increasing amounts of photocatalyst and/or photoinitiator being present in the composition. As general guidelines, actinic radiation typically involves a total energy exposure from about 0.1 to about 10 $J/cm^2$, and electron beam radiation typically involves a total energy exposure in the range from less than 1 Megarad to 100 Megarads or more, preferably 1 to 10 Mrads. Exposure times may be from less than about 1 second up to 10 minutes or more. Radiation exposure may occur in air or in an inert atmosphere such as nitrogen.

The particle size of the binder precursor particles of the present invention is not particularly limited so long as the particles can be adequately fused and then cured to form desired portions of bond system 18 with the desired level of uniformity and performance. If the particles are too big, it is more difficult to control the uniformity of coating thickness. Larger particles are also not as free flowing as smaller particles. Therefore, particles with a smaller average particle size such that the particles are in the form of a free flowing powder are preferred. However, extremely small particles may pose a safety hazard. Additionally, control over coating thickness also may become more difficult when using extremely small particles. Accordingly, as general guidelines, preferred binder precursor particles generally have an average particle size of less than about 500 micrometers, preferably less than about 125 micrometers, and more preferably 10 to 90 micrometers. In the practice of the present invention, the average particle size of the particles may be determined by laser diffraction using an instrument commercially available under the trade designation "HORIBA LA-910" from Horiba Ltd.

In preferred embodiments of the invention, the radiation curable component of the fusible binder precursor particles comprises one or more radiation curable monomers, oligomers, and/or polymers that, at least in combination, exist as a solid at about room temperature, for example, 20° C. to about 25° C., to facilitate dry coating under ambient conditions, but then melt or otherwise become fluidly flowable at moderate temperatures in the range from about 35° C. to about 180° C., preferably 40° C. to about 140° C., to facilitate fusing and curing without resort to higher temperatures that might otherwise damage other components of abrasive article 10. The term "monomer" as used herein refers to a single, one unit molecule capable of combination with itself or other monomers to form oligomers or polymers. The term "oligomer" refers to a compound that is a combination of 2 to 20 monomer units. The term "polymer" refers to a compound that is a combination of 21 or more monomer units.

Of course, in alternative, less preferred embodiments of the invention, the radiation curable component may exist as a solid only at relatively cool temperatures below ambient conditions. However, such embodiments would involve carrying out dry coating at correspondingly cool temperatures to ensure that the radiation curable component was solid during dry coating. Similarly, in other alternative embodiments of the invention, the radiation curable component may exist as a solid up to higher temperatures above about 180° C. However, such embodiments would involve carrying out melting and curing at correspondingly higher temperatures as well, which could damage other, temperature sensitive components of abrasive article 10.

Generally, any radiation curable monomer, oligomer, and/or polymer, or combinations thereof, that is solid under the desired dry coating conditions and that may be melted under the desired melt processing conditions may be incorporated into the radiation curable component. Accordingly, the present invention is not intended to be limited to specific kinds of radiation curable monomers, oligomers, and polymers so long as these processing conditions are satisfied. However, particularly preferred radiation curable components that have excellent flow characteristics when liquefied generally comprise at least one polyfunctional, radiation curable monomer and at least one polyfunctional, radiation curable macromolecule (that is, an oligomer or polymer, preferably an oligomer), wherein at least one of the monomer and/or the macromolecule has a solid to nonsolid phase transition at a sufficiently high temperature such that the combination of the monomer and macromolecule is a solid below about 35° C., but is liquefied at a temperature in the range from about 35° C. to about 180° C., preferably 40° C. to about 140° C. More preferably, it is the monomer that is a solid, by itself, and the macromolecule, by itself, may or may not be a solid under the noted temperature ranges. In the practice of the present invention, radiation curable components comprising one or more monomers and one or more oligomers are preferred over embodiments including polymers. Blends of oligomers and monomers tend to have lower viscosity and better flow characteristics at lower temperatures, thus easing melting and fusing of the particles during processing.

For example, representative embodiments of radiation curable components suitable in the practice of the present invention include the following components:

| Embodiment | Compounds |
|---|---|
| 1 | a solid, radiation curable, polyfunctional monomer having a melting point in the range from 35° C. to 180° C. |
| 2 | a solid, radiation curable, polyfunctional macromolecule having a glass transition temperature in the range from 35° C. to 180° C. |
| 3 | a solid blend including 10 to 90 parts by weight of a solid, radiation curable, polyfunctional monomer and 10 to 90 parts by weight of a solid, radiation curable, polyfunctional macromolecule |
| 4 | a solid blend including 10 to 90 parts by weight of a solid, radiation curable, polyfunctional monomer and 10 to 90 parts by weight of a liquid, radiation curable, polyfunctional macromolecule |
| 5 | a solid blend including 10 to 80 parts by weight of a liquid, radiation curable, polyfunctional monomer and 10 to 80 parts by weight of a solid, radiation curable, polyfunctional macromolecule |
| 6 | a solid blend comprising 0.1 to 10 parts by weight of a liquid, radiation curable, polyfunctional monomer and 100 parts by weight of a metal salt of a fatty acid (make coat and/or size coat) |
| 7 | a solid blend comprising 0 to 30 parts by weight of a liquid, |

-continued

| Embodiment | Compounds |
|---|---|
| | radiation curable, polyfunctional macromolecule and 100 parts by weight of a metal salt of a fatty acid (supersize coat) |
| 8 | a solid blend comprising 100 parts by weight of a solid, radiation curable, polyfunctional monomer and 0.1 to 10 parts by weight of a metal salt of a fatty acid (make coat and/or size coat) |
| 9 | a solid blend comprising 0 to 30 parts by weight of a solid, radiation curable, polyfunctional macromolecule and 100 parts by weight of a metal salt of a fatty acid (supersize coat) |

With respect to the monomer, the solid to nonsolid phase transition is typically the melting point of the monomer. With respect to the macromolecule, the solid to nonsolid phase transition is typically the glass transition temperature of the macromolecule. In the practice of the present invention, glass transition temperature, Tg, is determined using differential scanning calorimetry (DSC) techniques. The term "polyflnctional" with respect to the monomer or macromolecule means that the material comprises, on average, more than 1 radiation curable group, preferably two or more radiation curable groups, per molecule. Polyfunctional monomers, oligomers, and polymers cure quickly into a crosslinked network due to the multiple radiation curable groups available on each molecule. Further, polyfunctional materials are preferred in this invention to encourage and promote polymeric network formation in order to provide bond system 18 with toughness and resilience.

Preferred monomers, oligomers, and polymers of the present invention are aromatic and/or heterocyclic. Aromatic and/or heterocyclic materials generally tend to be thermally stable when melt processed and also tend to have melting point and/or Tg characteristics in the preferred temperature ranges noted above. As an option, at least one of the monomer and the macromolecule, preferably the macromolecule, further comprises OH, that is, hydroxyl, functionality. While not wishing to be bound by theory, it is believed that the OH functionality helps promote adhesion between abrasive particles 16 and the corresponding portion of bond system 18. Preferably, the macromolecule includes, on average, 0.1 to 1 OH groups per monomeric unit incorporated into the macromolecule.

For purposes of illustration, representative examples of suitable radiation curable monomers, oligomers, and polymers will now be described.

Figure 2:
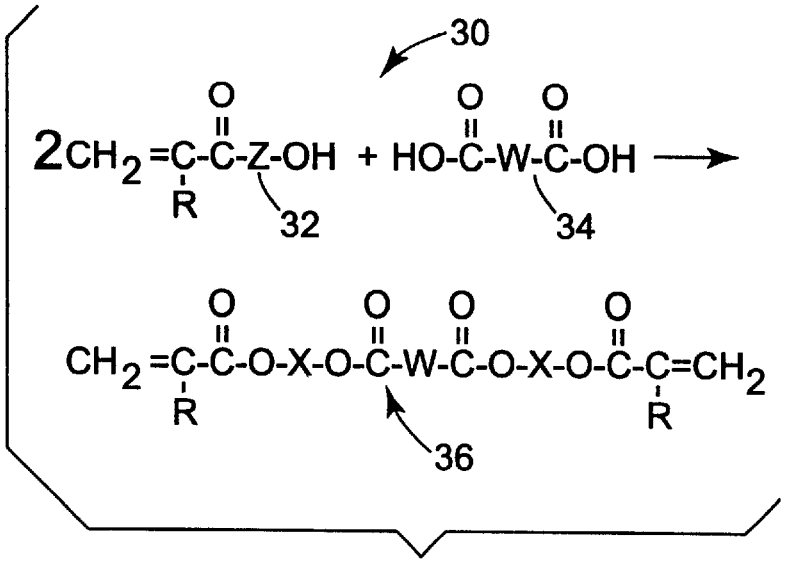
FIG. 2 schematically shows a reaction scheme for making one kind of radiation curable monomer suitable in the practice of the present invention.

One representative class of polyfunctional, radiation curable, aromatic monomers and/or oligomers is shown in FIG. 2. FIG. 2 schematically shows reaction scheme 30 by which hydroxyl functional (meth)acrylate reactant 32 reacts with dicarboxylic acid reactant 34 to form radiation curable, poly(meth)acrylate functional polyester monomer 36. The moiety W of reactant 34 desirably comprises an aromatic moiety for the reasons described above. The moiety Z is any suitable divalent linking group. Any kinds of hydroxyl functional (meth)acrylate reactant 32 and such aromatic dicarboxylic acid reactant 34 may be reacted together so long as the resultant radiation curable component is a solid under the desired dry coating conditions and has a melting point in the desired processing range. Examples of hydroxyl functional (meth)acrylate reactant 32 include hydroxyethyl acrylate, hydroxyethyl methacrylate, hydroxybutyl acrylate, hydroxybutyl methacrylate, combinations of these, and the like. Examples of aromatic dicarboxylic acid reactant 34 include terephthalic acid, isophthalic acid, phthalic acid, combinations of these, and the like. Although reactant 34 is shown as a dicarboxylic acid, an acid dihalide, diester, or the like could be used instead. The moiety X in monomer 36 is a divalent linking group typically identical to Z. R is hydrogen or a lower alkyl group of 1 to 4 carbon atoms, preferably —H or —$CH_3$.

Figure 3:
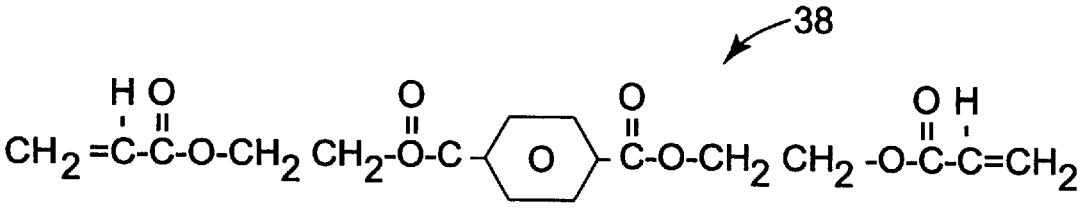
FIG. 3 is a preferred embodiment of radiation curable monomer prepared using the reaction scheme of FIG. 2.

FIG. 3 shows a particularly preferred embodiment of a radiation curable monomer 38 prepared in accordance with the reaction scheme of FIG. 2. Radiation curable monomer 38 has a melting point of 97° C. The radiation curable monomers 36 and 38 of FIGS. 2 and 3, and methods of making such monomers are further described in U.S. Pat. No. 5,523,152, incorporated herein by reference.

Figure 4:
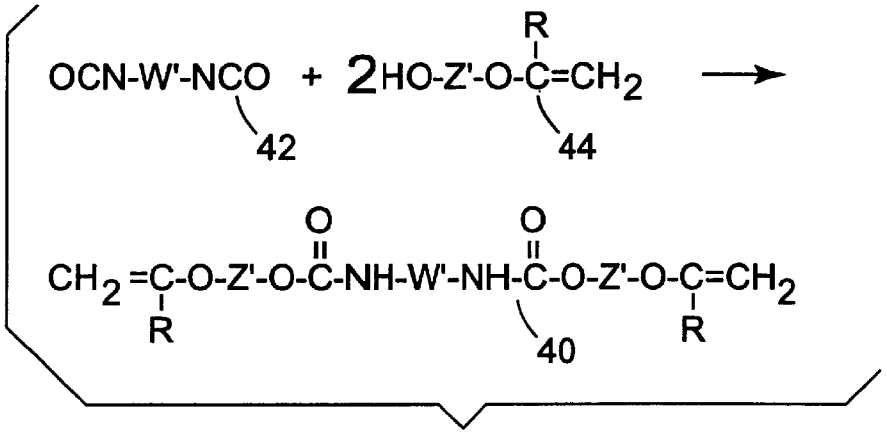
FIG. 4 schematically shows a reaction scheme for making another class of radiation curable monomer suitable in the practice of the present invention.

Another representative class of monomers in the form of radiation curable vinyl ether monomer 40 suitable in the practice of the present invention is shown as the product in FIG. 4 of a reaction between diisocyanate reactant 42 and hydroxyl functional vinyl ether reactant 44. The moiety W' desirably includes an aromatic moiety in the backbone for the reasons described above, and Z' is a suitable divalent linking group. R is as defined above in FIG. 2. Any kinds of hydroxyl functional vinyl ether reactant 44 and diisocyante reactant 42 may be reacted together so long as the resultant radiation curable component is a solid under the desired dry coating conditions and has a melting point in the desired processing range. Examples of hydroxyl functional vinyl ether reactant 44 include 4-hydroxybutyl vinyl ether (HO $CH_2$ $CH_2$ $CH_2$ $CH_2$ OCH=$CH_2$) and the like. Examples of diisocyanate reactant 42 include diphenylmethane-4,4-diisocyanate, toluene diisocyanate, combinations of these, and the like. The reaction scheme of FIG. 4 may also be carried out using a compound such as a hydroxyl functional (meth)acrylate in place of hydroxyl functional vinyl ether reactant 44.

Figure 5:
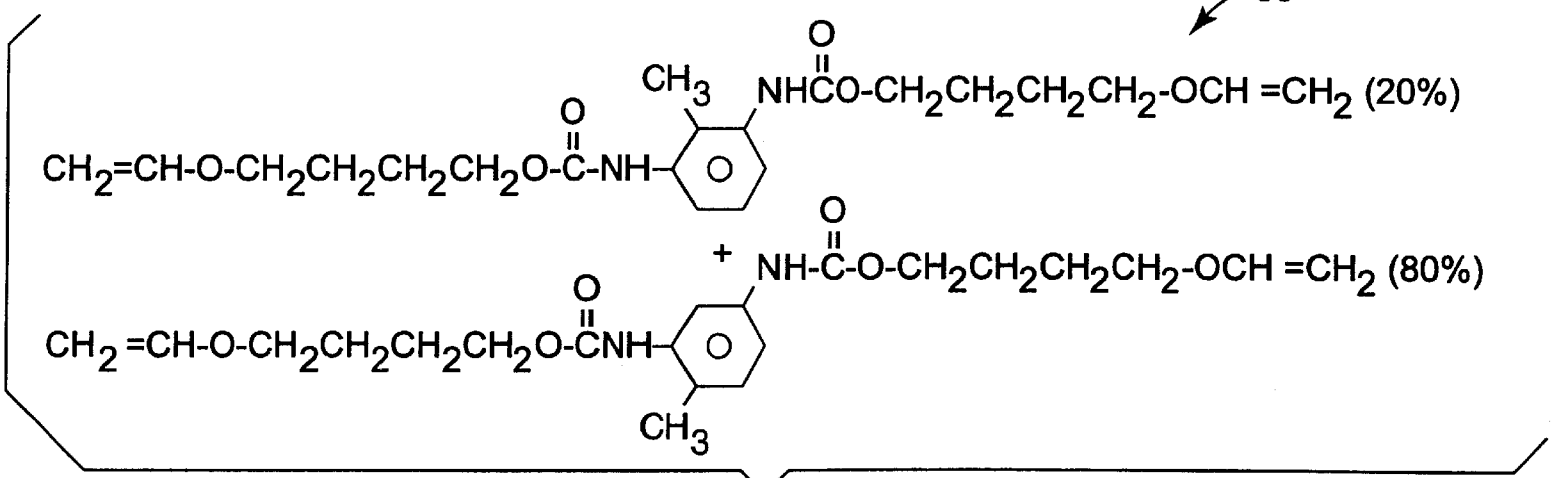
FIG. 5 is a preferred embodiment of radiation curable monomer prepared using the reaction scheme of FIG. 4.

FIG. 5 shows a particularly preferred embodiment of a radiation curable vinyl ether monomer 50 prepared in accordance with the reaction scheme of FIG. 4. Radiation curable vinyl ether monomer 50 has a melting point of 60–65° C.

Figure 6:
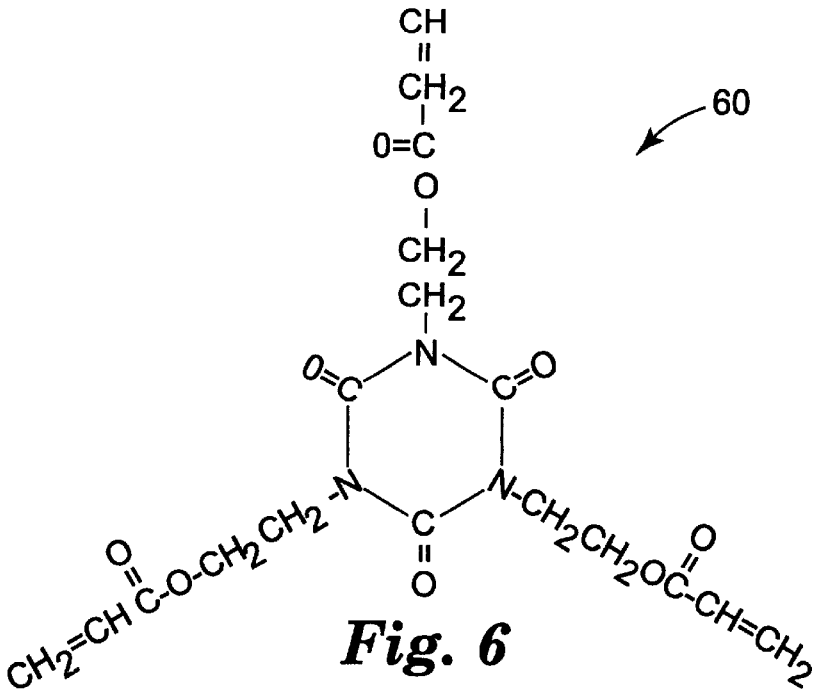
FIG. 6 is a preferred embodiment of another radiation curable monomer of the present invention.
Figure 7:
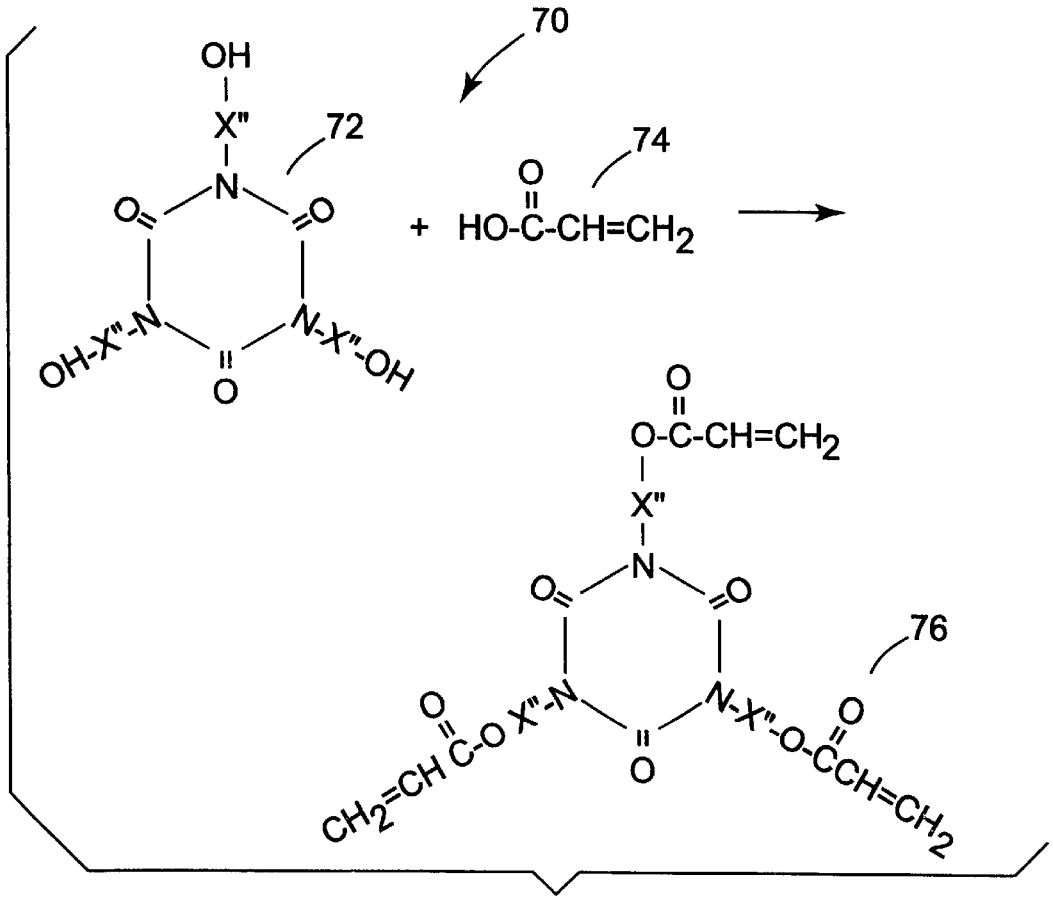
FIG. 7 schematically shows a reaction scheme for making the class of radiation curable monomers including the monomer of FIG. 6.

FIG. 6 shows another example of a suitable radiation curable, aromatic monomer 60 commonly referred to in the art as tris (2-hydroxyethyl) isocyanurate triacrylate, or "TATHEIC" for short. This monomer has a melting point in the range from 35° C. to 40° C. The TATHEIC monomer is generally formed by reaction scheme 70 of FIG. 7 in which hydroxyl functional isocyanurate 72 is reacted with carboxylic acid 74 to form acrylated isocyanurate 76. The X" moiety may be any suitable divalent linking group such as —$CH_2CH_2$— or the like. The acrylate form is shown in FIG. 6, but monomer 60 could be a methacrylate or the like as well.

Figure 8A:
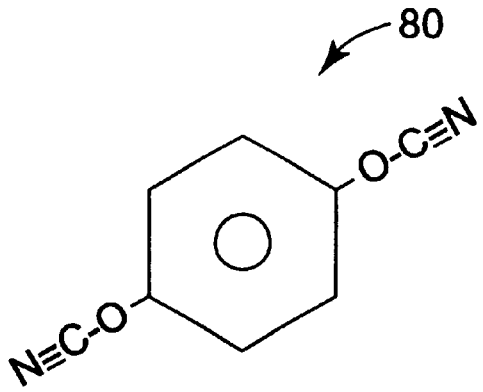
FIG. 8A is a preferred embodiment of another radiation curable monomer of the present invention.

FIG. 8A shows another example of a radiation curable, aromatic monomer in the form of an aromatic cyanate ester 80. This monomer has a melting point of 78° C. to 80° C.

This and similar monomers have been described in U.S. Pat. No. 4,028,393. Other cyanate esters are described in U.S. Pat. Nos. 5,215,860; 5,294,517; and 5,387,492, the cyanate ester descriptions incorporated by reference herein.

Other examples of radiation curable monomers that may be incorporated into the radiation curable component of the present invention include, for example, ethylene glycol diacrylate, ethylene glycol dimethacrylate, hexanediol diacrylate, hexanediol dimethacrylate, triethylene glycol diacrylate, triethylene glycol dimethacrylate, trimethylolpropane triacrylate, trimethylolpropane trimethacrylate, ethoxylated trimethylolpropane triacrylate, ethoxylated trimethylolpropane trimethacrylate, glycerol triacrylate, glycerol trimethacrylate, pentaerythritol triacrylate, pentaerythritol trimethacrylate, pentaerythritol tetracrylate, pentaerythritol tetramethacrylate, neopentylglycol diacrylate, and neopentylglycol dimethacrylate. Mixtures and combinations of different types of polyfunctional (meth) acrylates also can be used. Although some of these other monomer examples might not be solids under ambient conditions by themselves, blends of these monomers with other radiation curable ingredients may nonetheless provide particles having the desired solid characteristics.

Preferred radiation curable oligomers of the present invention generally have a number average molecular weight in the range from about 400 to 5000, preferably about 800 to about 2500 and either are solid at ambient conditions, or if not solid under ambient conditions, nonetheless form solid blends in combination with other ingredients of the radiation curable component. In addition to radiation curable functionality, preferred oligomers of the present invention also preferably include pendant hydroxyl functionality and are aromatic.

Figure 8B:
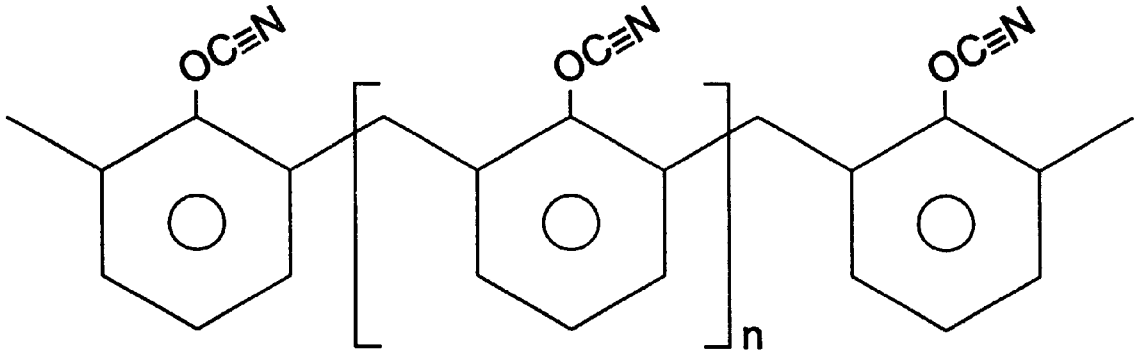
FIG. 8B is a cyanate ester novolak oligomer suitable in the practice of the present invention.
Figure 10:
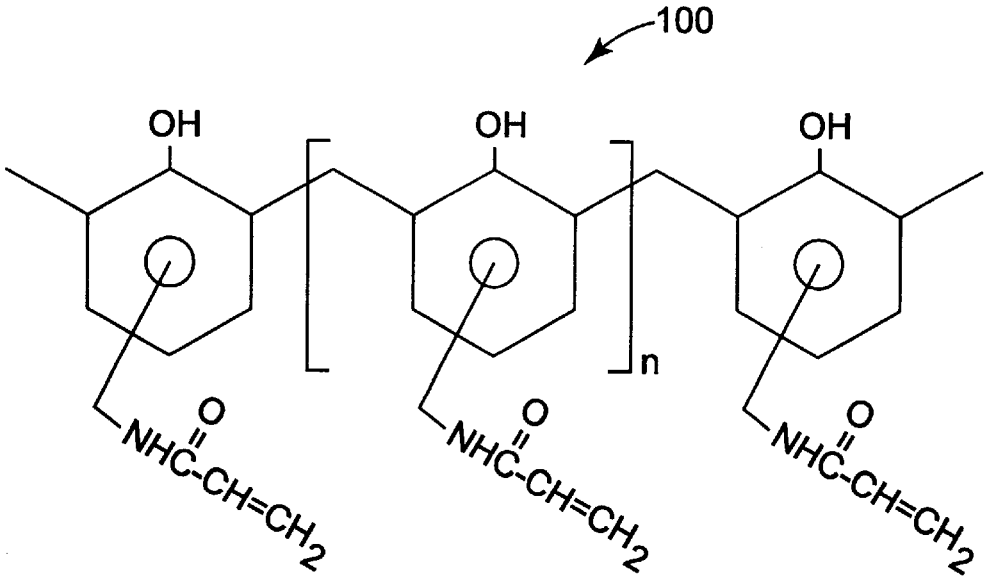
FIG. 10 shows the formula for one embodiment of a radiation curable novolak type phenolic oligomer suitable in the practice of the present invention.

One preferred class of radiation curable, hydroxyl functional, aromatic oligomers found to be suitable in the practice of the present invention includes the class of radiation curable, novolak-type phenolic oligomers. A representative radiation curable, aromatic novolak-type phenolic oligomer 90 having pendant cyanate ester functionality is shown in FIG. 8B, wherein n has a value in the range from about 3 to about 20, preferably 3 to 10. Another representative, radiation curable oligomer 100 having pendant acrylamide functionality and hydroxyl functionality (a combination of functionality that is particularly beneficial when incorporated into a make coat formulation) is shown in FIG. 10, wherein n has an average value in the range from about 3 to 20, preferably 3 to 10. In a particularly preferred embodiment, n has an average value of about 3 to 5. Interestingly, the resultant oligomer for which the average value of n is about 3 to 5 tends to have a taffy-like consistency under ambient conditions. Advantageously, however, such oligomer readily forms solid particles when combined with other solid, radiation curable monomers, oligomers, and polymers to facilitate dry coating, but flows easily when heated after dry coating, facilitating formation of uniform, fused binder matrices. The class of radiation curable, novolak-type phenolic oligomers, including the particular oligomer 100 shown in FIG. 10 has been described generally in U.S. Pat. Nos. 4,903,440 and 5,236,472, incorporated herein by reference.

Figure 11:
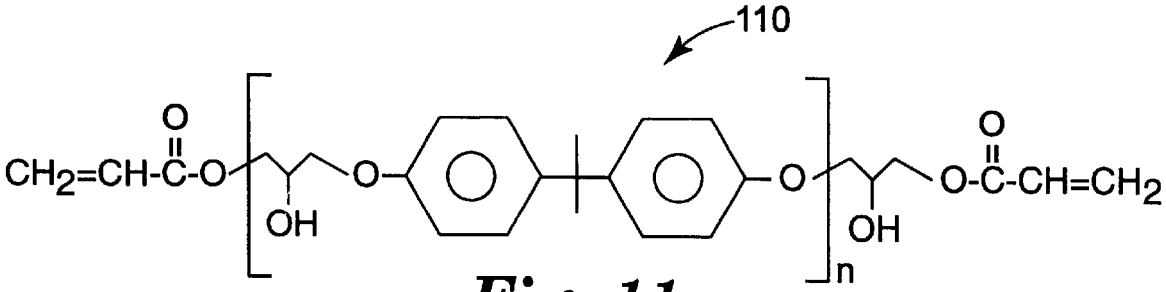
FIG. 11 shows a formula for one type of a radiation curable epoxy oligomer suitable in the practice of the present invention.

Another preferred class of radiation curable, hydroxyl functional, aromatic oligomers found to be suitable in the practice of the present invention includes the class of epoxy oligomers obtained, for example, by chain extending bisphenol A up to a suitable molecular weight and then functionalizing the resultant oligomer with radiation curable functionality. For example, FIG. 11 illustrates such an epoxy oligomer 110 which has been reacted with an acrylic acid to provide radiation curable functionality. Preferably, n of FIG. 11 has a value such that oligomer 110 has a number average molecular weight in the range from about 800 to 5000, preferably about 1000 to 1200. Such materials typically are viscous liquids under ambient conditions but nonetheless form solid powders when blended with other solid materials such as solid monomers, solid macromolecules, and/or calcium and/or zinc stearate. Accordingly, such materials also can be easily dry coated in solid form under ambient conditions, but then demonstrate excellent flow characteristics upon heating to facilitate formation of binder matrices having desired performance characteristics. Indeed, any oligomer that has this dual liquid/solid behavior under ambient conditions would be particularly advantageous with respect to achieving such processing advantages. Acrylate oligomers according to FIG. 11 are available under the trade designations "RSX29522" and "EBECRYL 3720", respectively, from UCB Chemicals Corp., Smyrna, Ga.

Of course, the oligomers suitable in the practice of the present invention are not limited solely to the preferred novolak-type phenolic oligomers or epoxy oligomers described above. For instance, other radiation curable oligomers that are solid at room temperature, or that form solids at room temperature in blends with other ingredients, include polyether oligomers such as polyethylene glycol 200 diacrylate having the trade designation "SR259" and polyethylene glycol 400 diacrylate having the trade designation "SR344," both being commercially available from Sartomer Co., Exton, Pa.; and acrylated epoxies available under the trade designations "CMD 3500," "CMD 3600," and "CMD 3700," from Radcure Specialties.

A wide variety of radiation curable polymers also can be beneficially incorporated into the radiation curable component, although polymers tend to be more viscous and do not flow as easily upon heating as compared to monomers and oligomers. Representative radiation curable polymers of the present invention comprise vinyl ether functionality, cyanate ester functionality, (meth)acrylate functionality, (meth)acrylamide functionality, cyanate ester functionality, epoxy functionality, combinations thereof, and the like. Representative examples of polymers that may be functionalized with one or more of these radiation curable groups include polyamides, phenolic resins, epoxy resins, polyurethanes, vinyl copolymers, polycarbonates, polyesters, polyethers, polysulfones, polyimides, combinations of these, and the like.

For example, in one embodiment, the radiation curable polymer may be an epoxy functional resin having at least one oxirane ring polymerizable by a ring opening reaction. These materials generally have, on the average, at least two epoxy groups per molecule (preferably more than two epoxy groups per molecule). The polymeric epoxides include linear polymers having terminal epoxy groups (for example, a diglycidyl ether of a polyoxyalkylene glycol), polymers having skeletal oxirane units (for example, polybutadiene polyepoxide), and polymers having pendent epoxy groups (for example, a glycidyl methacrylate polymer or copolymer). The number average molecular weight of the epoxy functional resin most typically may vary from about 1000 to about 5000 or more.

Another useful class of epoxy functional macromolecules includes those which contain cyclohexene oxide groups derived from monomers such as the epoxycyclohexanecarboxylates, typified by 3,4-epoxycyclohexylmethyl-3,4-epoxycyclohexane carboxylate, 3,4-epoxy-2-methylcyclohexylmethyl-3,4-epoxy-2-methylcyclohexane carboxylate, and bis(3,4-epoxy-6-methylcyclohexylmethyl) adipate. For a more detailed list of useful epoxides of this nature, reference may be made to U.S. Pat. No. 3,117,099, incorporated herein by reference.

Further epoxy functional macromolecules which are particularly useful in the practice of this invention include resins incorporating glycidyl ether monomers of the formula

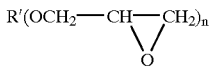

where R' is alkyl or aryl and n is an integer of 1 to 6. Examples are the glycidyl ethers of polyhydric phenols obtained by reacting a polyhydric phenol with an excess of chlorohydrin such as epichlorohydrin, for example, the diglycidyl ether of 2,2-bis-2,3-epoxypropoxyphenol propane. Further examples of epoxides of this type are described in U.S. Pat. No. 3,018,262, incorporated herein by reference.

There are also several commercially available epoxy macromolecules that can be used in this invention. In particular, epoxides which are readily available include octadecylene oxide, epichlorohydrin, styrene oxide, vinyl cyclohexene oxide, glycidol, glycidyl-methacrylate, diglycidyl ether of Bisphenol A (for example, those available under the trade designations "EPON 828," "EPON 1004," and "EPON 1001F" from Shell Chemical Co., and "DER-332" and "DER-334," from Dow Chemical Co.), diglycidyl ether of Bisphenol F (for example, "ARALDITE GY281" from Ciba-Geigy), vinylcyclohexene dioxide (for example, having the trade designation "ERL 4206" from Union Carbide Corp.), 3,4-epoxycyclohexyl-methyl-3,4-epoxycyclohexene carboxylate (for example, having the trade designation "ERL-4221" from Union Carbide Corp.), 2-(3,4-epoxycyclohexyl-5,5-spiro-3,4-epoxy) cyclohexane-metadioxane (for example, having the trade designation "ERL-4234" from Union Carbide Corp.), bis(3,4-epoxycyclohexyl) adipate (for example, having the trade designation "ERL-4299" from Union Carbide Corp.), dipentene dioxide (for example, having the trade designation "ERL-4269" from Union Carbide Corp.), epoxidized polybutadiene (for example, having the trade designation "OXIRON 2001" from FMC Corp.), silicone resin containing epoxy functionality, epoxy silanes, for example, beta-3,4-epoxycyclohexylethyltri-methoxy silane and gamma-glycidoxypropyltrimethoxy silane, commercially available from Union Carbide, flame retardant epoxy resins (for example, having the trade designation "DER-542," a brominated bisphenol type epoxy resin available from Dow Chemical Co.), 1,4-butanediol diglycidyl ether (for example, having the trade designation "ARALDITE RD-2" from Ciba-Geigy), hydrogenated bisphenol A-epichlorohydrin based epoxy resins (for example having the trade designation "EPONEX 1510" from Shell Chemical Co.), and polyglycidyl ether of phenol-formaldehyde novolak (for example, having the trade designation "DEN-431" and "DEN-438" from Dow Chemical Co.).

It is also within the scope of this invention to use an epoxy functional macromolecule that has both epoxy and (meth) acrylate functionality. For example, one such resin having such dual functionality is described in U.S. Pat. No. 4,751,138 (Tumey et al.), which is incorporated herein by reference.

In addition to the radiation curable component, the binder precursor particles of the present invention may also include a thermoplastic resin in order to adjust the properties of the particles and/or the resultant cured binder matrix. For example, thermoplastic resins can be incorporated into the particles in order to adjust flow properties of the particles upon being melted, to allow the melt layer to display pressure sensitive adhesive properties so that abrasive particles more aggressively adhere to the melt layer prior to curing (desirable for a make coat), to adjust the flexibility characteristics of the resultant cured binder matrix, combinations of these objectives, and the like. Just a few examples of the many different kinds of thermoplastic polymers useful in the present invention include polyester, polyurethane, polyamide, combinations of these, and the like. When used, the binder precursor particles may include up to 30 parts by weight of a thermoplastic component per 100 parts by weight of the radiation curable component.

In alternative embodiments of the present invention, rather than using binder precursor particles as described above to form supersize coat 24, at least a portion of supersize coat 24 can be made from a fusible powder comprising at least one metal salt of a fatty acid. Advantageously, metal salts of a fatty acid function as an antiloading agent, a binder component, and/or a flow control agent, when incorporated into supersize coat 24. Although not required, the fusible powder may also include a binder comprising one or more monomers and/or macromolecules that may be thermoplastic, thermally curable, and/or radiation curable as described above in connection with the binder precursor particles. In typical embodiments, the fusible powder comprises 70 to 95 parts by weight of at least one metal salt of a fatty acid and 0 to 30 parts by weight of the binder.

Figure 9:
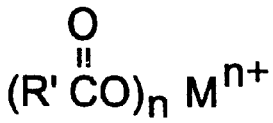
FIG. 9 shows a general formula for a metal salt of a fatty acid suitable in the practice of the present invention.

The metal salts of a fatty acid ester suitable for use in the fusible powder generally may be represented by formula 90 shown in FIG. 9 wherein R' is a saturated or unsaturated moiety, preferably an alkyl group having at least 10, preferably 12 to 30, carbon atoms, M is a metal cation having a valence of n, wherein n typically is 1 to 3. Specific examples of compounds according to formula 90 of FIG. 9 include lithium stearate, zinc stearate, calcium stearate, magnesium stearate combinations of these, and the like. The metal salt of a fatty acid preferably is calcium stearate, zinc stearate, or a combination thereof wherein the weight ratio of calcium stearate to zinc stearate is in the range from 1:1 to 9:1. The use of a powder comprising a combination of calcium and zinc stearates also provides an excellent way to control the melting characteristics of the powder. For example, if it is desired to increase the melting temperature of the powder, the amount of calcium stearate being used can be increased relative to the amount of zinc stearate. Conversely, if it is desired to lower the melting temperature of the powder, the amount of zinc stearate being used can be increased relative to the amount of calcium stearate. Calcium stearate is unique in that this material never truly melts. However, in fine powder form, for example, a powder having an average particle size of less than about 125 micrometers, calcium stearate can be used by itself, or in combination with other materials, to provide powders that readily flow when heated at moderately low processing temperatures.

Uniquely, solid embodiments of metal salts of fatty acids, for example, the metal stearates, may be blended with liquid monomers, oligomers, and/or polymers to form blends that, nonetheless, are solid and can be ground to form fine powders. Such powders have excellent viscosity, fusing, and flow characteristics when melt processed at reasonably low melt processing temperatures. Embodiments demonstrating this advantage of the invention will be described further below in the examples.

Optimally, the fusible powder of the present invention may include one or more fatty acids. Advantageously, the presence of a fatty acid makes it easier to melt process the fusible powder at reasonably low processing temperatures, for example, 35° C. to 180° C. For example, a preferred embodiment of a fusible powder of the present invention might include calcium stearate (a metal salt of a fatty acid) as a major component. A fusible powder including just calcium stearate by itself tends to be difficult to melt process, because calcium stearate never truly melts. However, if a fatty acid is incorporated into the fusible powder along with calcium stearate, the resultant blend can be readily melt processed at convenient temperatures.

Generally, preferred embodiments of the present invention include a sufficient amount of a fatty acid so that the fusible powder can be melt processed at the desired temperature, for example a temperature in the range from 35° C. to 180° C. Preferred fusible powders of the present invention incorporate up to 30, preferably about 10, parts by weight of one or more fatty acids per 70 to 100, preferably about 90, parts by weight of the metal salt of a fatty acid. Although any fatty acid can be used in the present invention, a preferred fatty acid is the corresponding acid form of the metal salt of a fatty acid being used. For instance, stearic acid is a preferred fatty acid when the metal salt of a fatty acid is a stearate, for example, zinc stearate or calcium stearate.

The binder precursor particles and/or fusible powder of the present invention may also include one or more grinding aids. Useful examples of classes of grinding aids include waxes, organic halide compounds, halide salts, metals, and alloys of metals. Organic halide compounds typically break down during abrading and release a halogen acid or a gaseous halide compound. Examples of organic halides include chlorinated waxes, such as tetrachloronapthalene, pentachloronapthalene, and polyvinyl chloride. Chlorinated waxes can also be considered to be waxes. Examples of halide salts include sodium chloride (NaCl), potassium chloride (KCl), potassium fluoroborate ($KBF_4$), ammonium cryolite $(NH4)_3AlF_6$), cryolite ($Na_3AlF_6$),and magnesium chloride ($MgCl_2$). Examples of metals include tin, lead, bismuth, cobalt, antimony, cadmium, iron, and titanium. Other grinding aids include sulfur and organic sulfur compounds, graphite, and metallic sulfides. Combinations of grinding aids can be used. The preferred grinding aid for stainless steel is potassium fluoroborate. The preferred grinding aid for mild steel is cryolite. The ratio of the fusible organic component to grinding aid ranges from 0 to 95, preferably ranges from about 10 to about 85, more preferably about 15 to about 60, parts by weight of a fusible organic component to about 5 to 100, preferably about 15 to about 85, more preferably about 40 to about 85, parts by weight grinding aid.

The binder precursor particles and/or fusible powder of the present invention additionally may comprise one or more optional additives, such as, plasticizers, other antiloading agents (that is, materials useful for reducing or preventing swarf accumulation), grinding aids, surface modification agents, fillers, flow agents, curing agents, hydroxyl containing additives, tackifiers, grinding aids, expanding agents, fibers, antistatic agents, lubricants, pigments, dyes, UV stabilizers, fungicides, bacteriocides, and the like. These additional kinds of additives may be incorporated into the binder precursor particles in according to conventional practices.

Selecting a suitable composition of the binder precursor particles and/or fusible powder for a particular application will depend, to a large extent, upon the portion of bond system 18 into which the particles will be incorporated. Different compositions may be more desirable depending upon whether the binder precursor particles are to be incorporated into make coat 20, size coat 22, and/or supersize coat 24. Further, not all binder precursor particles to be incorporated into bond system 18 need be the same. Binder precursor particles of one composition, for instance, may be incorporated into make coat 20 and size coat 22, while binder precursor particles of a second composition are incorporated into supersize coat 24.

In one embodiment of the present invention suitable for use in make coat 20 and/or size coat 22, a preferred binder precursor particle composition (Make/Size Composition I) comprises 100 parts by weight of a radiation curable binder component, about 1 to 5 parts by weight of a flow control agent, and about 0.5 to 5 parts by weight of a photoinitiator or photocatalyst. The preferred radiation curable binder component comprises a (i) solid, radiation curable monomer and (ii) a solid radiation curable oligomer and/or polymer, wherein the weight ratio of the monomer to the oligomer/polymer is in the range from 1:10 to 10:1, preferably 1:4 to 4:1, more preferably about 1:1. Preferred examples of the solid monomer include the monomer of FIG. 3, the cyanate ester of FIG. 8, and the TATHEIC monomer of FIG. 6. Preferred examples of the solid oligomer/polymer include the epoxy functional resin commercially available under the trade designation "EPON 1001F" from Shell Chemical Co. and the acrylate functional oligomer available under the trade designation "RSX 29522" from UCB Chemicals Corp. Preferred flow control agents include waxes and acrylic copolymers commercially available under the trade designation Modarez MFP-V from Synthron, Inc., metal stearates such as zinc stearate and/or calcium stearate, combinations of these, and the like. These ingredients may be melt blended together, cooled, and then ground into a free flowing powder of the desired average particle size.

In an alternative embodiment of the present invention suitable for forming make coat 20 and size coat 22, a composition (Make/Size Composition II) identical to Make/Size Composition I is used, except that a liquid oligomer and/or polymer is substituted for the solid oligomer/polymer. Most preferably, the liquid oligomer or polymer is highly viscous. "Highly viscous" means that the material is a liquid at 25° C. and has a weight average molecular weight of at least about 5000, preferably at least about 8000, more preferably at least about 10,000. Preferred examples of highly viscous oligomers and polymers include the oligomer of FIG. 10 in which n is about 5, as well as the acrylate functional resin of FIG. 11.

For another embodiment of the present invention suitable for use in supersize coat 24, a preferred binder precursor particle composition (Supersize Composition I) comprises 75 to 95 parts by weight of a solid metal salt of a fatty acid, about 5 to 25 parts by weight of a liquid, radiation curable monomer, oligomer and/or polymer, and about 1 to 5 parts by weight of a photoinitiator or photocatalyst. Notwithstanding the liquid character of the radiation curable monomer, oligomer, and/or polymer, the ingredients can be melt blended, cooled, and then ground to form a free flowing, solid powder. Preferred metal salts of a fatty acid include zinc stearate, calcium stearate, and combinations of these. Preferred liquid materials include acrylate functional epoxy oligomers available under the trade designations "EBECRYL 3720 and 302", acrylate functional polyester available under the trade designation "EBECRYL 450", acrylate functional polyurethanes available under the trade designation "EBECRYL 8804 and 270", ethoxylated trimethylol propane triacrylate, and the novolak-type phenolic oligomer of FIG. 10, wherein n is about 5.

For another embodiment of the present invention suitable for use in supersize coat 24, a preferred binder precursor particle composition (Supersize Composition II) is identical to Supersize Composition I except that one or more solid radiation curable monomers, oligomers, and/or polymers is substituted for the liquid radiation curable materials. Preferred examples of the solid radiation curable material include the monomer of FIG. 3, the cyanate ester of FIG. 8, and the TATHEIC monomer of FIG. 6. Preferred examples of the solid oligomer/polymer include the epoxy functional resin commercially available under the trade designation "EPON 1001F" and the acrylate functional oligomer available under the trade designation "RSX 29522".

For another embodiment of the present invention suitable for use in supersize coat 24, a preferred binder precursor particle composition (Supersize Composition III) comprises 70 to 95 parts by weight of a metal salt of a fatty acid as described above, 5 to 30 parts by weight of a thermoplastic resin, and optionally 5 to 30 parts by weight of a solid or liquid radiation curable component as described above. Preferred examples of thermoplastic resins include polyamides, polyesters, ethylene vinyl acetate copolymers, combinations of these, and the like. A particularly preferred resin is available from Union Camp Chemical Product Division under the trade designation "UNIREZ 2221".

For another embodiment of the present invention suitable for use in supersize coat 24, a preferred binder precursor particle composition (Supersize Composition IV) comprises 70 to 95 parts by weight of the metal salt of a fatty acid as described above and 5 to 20 parts by weight of a thermosetting resin other than a radiation curable resin. Preferred examples of the thermosetting resin include phenol-formaldehyde resins (that is, novolak type phenolic resins and powdered resole resins) such as the resin available under the trade designation "VARCUM 29517" from the Durez Division of the Occidental Chemical Corp. ("Oxychem"), and urea-formaldehyde resins such as the resin available under the trade designation "AEROLITE UP4145" from Dynochem UK, Ltd.; and the EPON™ 1001F epoxy resin.

The binder precursor particles and/or fusible powder of the present invention are easily made by a process in which all of the ingredients to be incorporated into the particles or powder, as the case may be, are first blended together to form a homogeneous, solid admixture. Blending can be accomplished by dry blending the ingredients together in powder form, but more preferably is accomplished by melt processing in which at least the radiation curable ingredients of the particles are liquefied during blending. Typically, melt processing occurs at a temperature above the glass transition temperatures and/or melting points of at least some of the radiation curable ingredients, while nonetheless occurring at a sufficiently low temperature to avoid premature crosslinking of the binder components. The melt processing temperature is also below temperatures that might degrade any temperature sensitive ingredients of the particles. The particular technique used to accomplish melt processing and blending is not critical, and any convenient technique can be used. As one example, processing the ingredients through an extruder to form a solid, blended extrudate is suitable, so long as extruder temperature is carefully monitored to avoid premature crosslinking of, and degradation to, the ingredients.

After the solid blend is formed, the resultant solid can then be milled, for example, ground, into particles of the desired particle size. The type of milling technique is not critical and representative examples include cryogenic grinding, hammer milling (either cold or at room temperature), using a mortar and pestle, using a coffee grinder, ball milling, and the like. Hammer milling at room temperature is presently preferred.

Depending upon the composition of the particles, the dry particles can then be used, without use of any solvent whatsoever, to form the binder matrix component of make coat 20, size coat 22, and/or supersize coat 24, as desired. Generally, the particles may be applied to an underlying surface of abrasive article 10 using any convenient dry coating technique such as drop coating, electrostatic spraying, electrostatic fluidized bed coating, hot melt spraying, and the like. After coating, the particles are liquefied, preferably by heating, in a manner such that the particles fusibly flow together to form a uniform, fluid melt layer. The melt layer can then be exposed to a suitable source of energy in order to cure the melt layer so that a thermoset, solid, binder matrix is formed. In the case of forming make coat 20, abrasive particles 16 to be incorporated may be codeposited with the dry binder precursor particles if desired. Alternatively, it is also possible to sequentially and separately apply the binder precursor particles and abrasive particles 16 in any order. For example, the binder precursor particles can be dry coated and liquefied first, after which abrasive particles 16 are coated into the melt layer prior to curing. In order to promote the adhesion of make coat 20 to backing 12, it may be desirable to modify, for example, prime, the surface of backing 12 to which make coat 20 is applied. Appropriate surface modifications include corona discharge, ultraviolet light exposure, electron beam exposure, flame discharge and scuffing.

Figure 12:
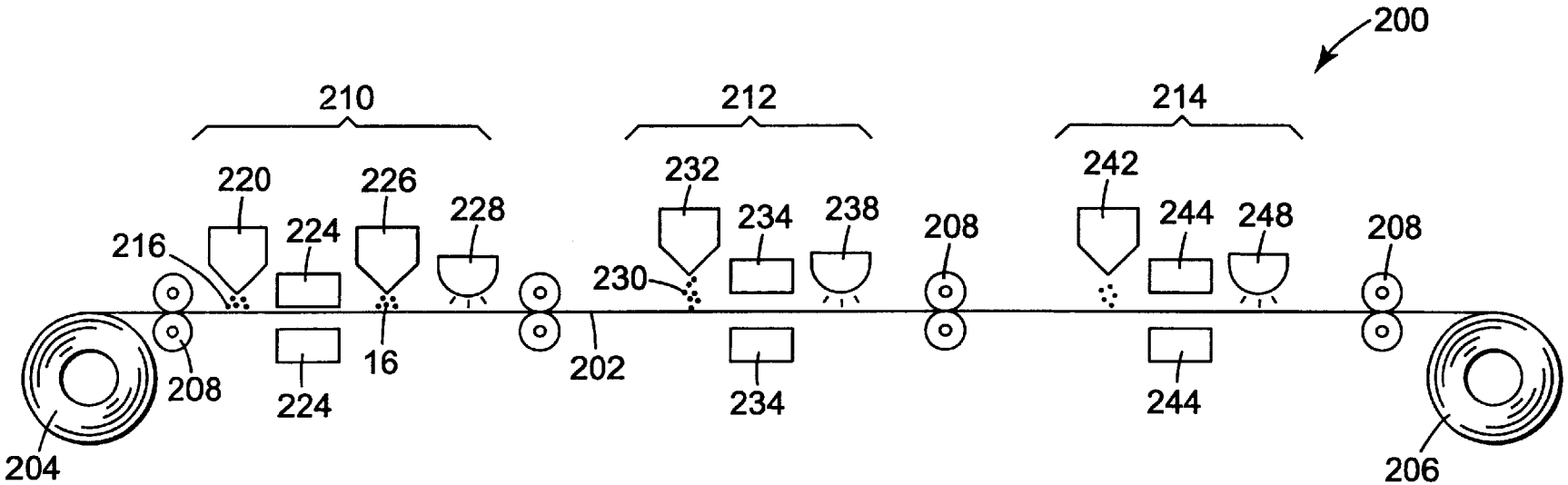
FIG. 12 is a schematic representation of an apparatus for making a coated abrasive of the present invention having make, size and supersize coatings.

With reference to abrasive article 10 of FIG. 1, FIG. 12 is a schematic representation of an apparatus 200 suitable for forming abrasive article 10. For purposes of illustrating the versatility of the present invention, FIG. 12 shows forming each of make coat 20, size coat 22, and supersize coat 24 of abrasive article 10 from binder precursor particles of the present invention. However, it is to be understood that the present invention is not limited to the illustrated application in which the entirety of bond system 18 is formed from the binder precursor particles, but rather is applicable to circumstances in which any one or more portions of bond system 18 is derived from such binder precursor particles.

FIG. 12 shows backing 202 being transported from supply roll 204 to take-up roll 206. Typically, backing 202 may be transported at a speed in the range from 0.1 m/min to as much as 100 m/min or more. During transit between supply roll 204 and take up roll 206, backing 202 is supported upon suitable number of guide rollers 208 as backing 202 passes through coating stations 210, 212, and 214. Make coat 20, size coat 22, and supersize coat 24 are applied at stations 210, 212, and 214, respectively. Firstly, at station 210, binder precursor particles 216 corresponding to the binder matrix of make coat 20 are drop coated onto backing 202 from dry coating apparatus 220. Backing 202 then passes through oven 224 in which particles 216 are heated to form a liquefied make coat melt layer. Abrasive particles 16 are then electrostatically coated into the make coat melt layer from mineral coater 226. The coated backing then passes ultraviolet light source 228, where the make coat melt layer is exposed to ultraviolet radiation to crosslink and cure the make coat. The crosslinked make coat now firmly bonds abrasive particles 16 to backing 202.

Next, the coated backing 202 passes through station 212 to form size coat 22. Binder precursor particles 230 corresponding to the binder matrix of size coat 22 are drop coated onto make coat 20 from dry coating apparatus 232. The coated backing 202 then passes through oven 234 in which particles 230 are heated to form a liquefied size coat melt layer. The coated backing then passes ultraviolet light source 238, where the size coat melt layer is exposed to ultraviolet radiation to crosslink and cure the size coat. The crosslinked size coat now helps reinforce the attachment of abrasive particles 16 to backing 202.

Next, the coated backing 202 passes through station 214 to form supersize coat 24. Binder precursor particles 240 corresponding to the binder matrix of supersize coat 24 are drop coated onto size coat 22 from dry coating apparatus 242. The coated backing 202 then passes through oven 244 in which particles 240 are heated to form a liquefied supersize coat melt layer. The coated backing 202 then passes ultraviolet light source 248, where the supersize coat melt layer is exposed to ultraviolet radiation to crosslink and cure the supersize coat. The crosslinked supersize coat now helps provide abrasive article 10 with desired performance characteristics, for example, anti-loading capabilities if supersize coat 24 incorporates an antiloading agent.

The finished abrasive article 10 is then stored on take-up roll 206, after which abrasive article may be cut into a plurality of sheets, discs or the like, depending upon the desired application. Of course, instead of being directly stored on take-up roll 206, abrasive article 10 may be transported directly to a cutting apparatus to form sheets or discs, after which the sheets or discs may be stored, packaged for distribution, used, or the like.

The invention will be more fully understood with reference to the following nonlimiting examples in which all parts, percentages, ratios, and so forth, are by weight unless otherwise indicated.

Abbreviations for the materials defined in the above detailed description and used in the following samples are shown in the following schedule.

| | |
|---|---|
| | Thermoplastic |
| DS1227 | High molecular weight polyester commercially available from Creanova, Piscataway, NJ under the trade designation "DYNAPOL S1227" |
| Elvax 310 | Ethylene vinyl acetate copolymer commercially available from E. I. Du Pont de Nemours and Company Inc., Willmington, DE |
| Unirez 2221 | Dimer acid hot melt polyamide commercially available form Union Camp, Chemical Products Division, Jacksonville, FL |
| | Thermosetting Resins |
| DZ1 | Novolak type powdered phenolic resin commercially available from OxyChem, Occidental Chemical Corporation, Durez EngineeringMaterials, Dallas, TX under the trade designation "Durez 12687" |
| DZ2 | Novolak type powdered phenolic resin commercially available from OxyChem, Occidental Chemical Corporation, Durez Engineering Materials, Dallas, TX under the trade designation "Durez 12608" |
| VM1 | Novolak type powdered phenolic resin commercially available from OxyChem, Occidental Chemical Corporation, Durez Engineering Materials, Dallas, TX under the trade designation "Varcum 29517" |
| UF1 | Powdered urea-formaldehyde resin available from Dynochem UK Ltd, Cambridge, UK. under the trade designation "Aerolite UP 4145" |
| UF2 | Urea-formaldehyde liquid resin commercially available from Borden Chemical Inc., Louisville, KY under the trade designation "Durite Al-3029 R" |

-continued

| | |
|---|---|
| | Radiation Curable or thermally curable epoxy resins |
| EP1 | Bisphenol A epoxy resin commercially available from Shell Chemical, Houston, TX under the trade designation "EPON 828" (epoxy equivalent weight of 185–192 g/eq.) |
| EP2 | Bisphenol A epoxy resin commercially available from Shell Chemical, Houston, TX under the trade designation "EPON 828" (epoxy equivalent weight of 185–192 g/eq.) |
| ERL 4221 | Cycloaliphatic epoxy resin commercially available from Union Carbide Chemicals and Plastics Company Inc., Danbury, CT |
| | Radiation Curable Momomers, Oligomers and Polymers |
| EB1 | Bisphenol A epoxy acrylate commercially available from UCB Chemicals Corp., Smyrna, GA under the trade designation "Ebecryl 3720" |
| EB2 | Fatty acid modified epoxy acrylate commercially available from UCB Chemicals Corp., Smyrna, GA under the trade designation "Ebecryl 3702" |
| EB3 | Polyester hexa-acrylate commercially available from UCB Chemicals Corp., Smyrna, GA under the trade designation "Ebecryl 450" |
| RSX 29522 | Experimental solid acrylated epoxy oligomer obtained from UCB Chemicals Corp, Smyrna, GA |
| TRPGDA | Tripropylene glycol diacrylate commercially available from Sartomer Co., Exton, PA under the trade designation "SR306" |
| TMPTA | Trimethylol propane triacrylate commercially available from Sartomer Co., Exton, PA under the trade designation "SR351" |
| AMN | Acrylamidomethyl novolak resin in U.S. Pat. 4,903,440 and 5,236,472 |
| PDAP | p-Di(acryloyloxyethyl)terephthalate, prepared as described below at IIA |
| PAN | O-Acrylated novolak resin, prepared as described below at IIA |
| PT 60 | Cyanate ester novolak commercially available from Lonza Inc., Fair Lawn, NJ under the tradename "Primaset PT 60" |
| | Metal salts of fatty acids/Antiloading agents |
| ZnSt2 | Zinc stearate commercially available from Witco Chemical Corporation, Memphis, TN under the tradename "Lubrazinc W" |
| CaSt2 | Calcium stearate commercially available from Witco Chemical Corporation, Memphis, TN under the tradename "Calcium Stearate Extra Dense G" |
| LiSt | Lithium stearate commercially available from Witco Chemical Corporation, Memphis, TN under the tradename "Lithium Stearate 304" |
| StA | Stearic acid commercially available from Aldrich Chemical of Milwaukee, WI |
| | Grinding Aids |
| KBF4 | Potassium Fluoroborate commercially available from Aerotech USA Inc., under the trade designation "POTASSIUM FLUOROBORATE SPEC. 102." |
| | Abrasive particles |
| P180 AlO | Grade P180 aluminum oxide particles, commercially available from Triebacher Schleifmittel AG, Villach, Austria |
| P400 SiC | Grade P400 silicon carbide particles, commercially available from Triebacher Schleifmittel AG, Villach, Austria |
| P80 CUB | Grade P80 ceramic aluminum oxide particles, commercially available from Minnesota Mining and Manufacturing Company, St. Paul, MN |

-continued

| | |
|---|---|
| P80 AO | Grade P80 aluminum oxide particles, commercially available from Triebacher Schleifmittel AG, Villach, Austria |
| 50 AZ | Grade 50 ceramic aluminum oxide particle commercially available from Norton, WHERE |
| | Hydroxyl containing materials |
| CHDM | Cyclohexanedimethanol commercially available from Eastman Chemical Company, Kingsport, CT |
| SD 7280 | Novolak type powdered phenolic resin (uncatalyzed) commercially available from Borden Chemical Inc., Louisville, KY |
| | Initiators/Catalysts |
| "KB1" | 2,2-Dimethoxy-1,2-diphenyl-1-ethanone commercially available from Sartomer Co., Exton, PA under the trade designation "KB1" |
| IRG1 | 2,2-Dimethoxy-1,2-diphenyl-1-ethanone commercially available from Ciba Speciality Chemicals, under the trade designation "IRGACURE 651" |
| COM | $Eta^6$-[xylenes(mixed isomers)]$eta^5$ cyclopentadienyliron (1+) hexafluoroantimonate (1−) (acts as a photocatalyst) as described in U.S. Pat. Nos. 5,059,701; 5,191,101 and 5,252,694 |
| AMOX | Di-t-amyloxalate (acts as an accelerator) as described in U.S. Pats. 5,252,694 and 5,436,063 |
| IMID | 2-Ethyl-4-methylimidazole, commercially available from Aldrich Chemical, Milwaukee, WI |
| PTSOH | p-Toloune sulfonic acid , commercially available from Aldrich Chemical Milwaukee, WI |
| ACL | Aluminum chloride, commercially available from Aldrich Chemical, Milwaukee, WI |
| | Fillers |
| FLDSP | Feldspar, commercially available from K-T Feldstar Corporation, GA under the trade designation "Minspar 3" |
| CRY | Crolite commercially available from TR International Trading Company Inc., Houston, TX under the trade designation "RTNC CRYOLITE" |
| $CaCO_3$ | Calcium carbonate |
| FEO | Iron oxide |
| | Flow control agents |
| MOD | Powder coating flow agent commercially available from Sythron Inc, Moganton, NC under the trade designation "Modarez MFP-V" |
| CAB-O-SIL | Hydrophobic treated amorphous fumed silica, commercially available from Cabot Corporation, Tuscola, IL, under the trade designation "CAB-O-SIL TS-720" |
| | Solvents |
| Ethyl Acetate | Ethyl acetate is commercially available from Aldrich Chemical, Milwaukee, WI |

EXAMPLE I

Preparation of Abrasive Articles Comprising a Backing Layer and Abrasive Coating Comprising a Supersize Coat A. Preparation of Abrasive Articles Comprising a Backing Layer and an Abrasive Coating 1. Abrasive Article A These abrasive articles used a backing that was a 95 g/m$^2$ paper backing C90233 EX commercially available from Kimberly-Clark, Neenah, Wis. For each, a make coat precursor was prepared from DS1227 (20.7 parts), EP1 (30.5 parts), EP2 (33.7 parts), CHDM (2.9 parts), COM (0.6 part), KB1 (1.0 part) and AMOX (0.6 parts). The batch was prepared by melting DS 1227 and EP2 together at 140° C., mixing, then adding EP1 and CHDM. Then, TMPTA (4.5 parts) was added with mixing at 100° C. To this sample was added COM, AMOX, and KB1 followed by mixing at 100° C. The make coat precursor was applied at 125° C. by means of a knife coater to the paper backing at a weight of about 20 g/m$^2$. The sample was then irradiated (3 passes at 18.3 m/min) with one 400 W/cm "D" bulb immediately before P180 AO abrasive particles were electrostatically projected into the make coat precursor at a weight of about 85 g/m$^2$. The intermediate product was thermally cured for 15 minutes at a temperature of 100° C.

A size coat precursor was roll coated over the abrasive grains at a weight of about 50 g/m$^2$. The size coat precursor included a 100% solids blend of EP1 (40 parts), ERL 4221 (30 parts), TMPTA (30 parts), KB1 (1 part), and COM (1 part). The sample was then irradiated (3 passes at 18.3 m/min) with one 400 W/cm "D" bulb followed by a thermal cure for 10 minutes at 100° C.

2. Abrasvie Article B

Abrasive article B was prepared by the same methodology as described above using the formulations shown in Table 1.

3. Comparative Samples B, D, F, H, J, K, N, P, BB, DD, FF, HH, JJ

Abrasive articles used a backing that was a 95 g/m$^2$ paper backing C90233 EX commercially available from Kimberly-Clark, Neenah, Wis. For each, a make coat precursor was prepared from DS1227 (20.7 parts), EP1 (30.5 parts), EP2 (33.7 parts), CHDM (2.9 parts), COM (0.6 part), KB1 (1.0 part) and AMOX (0.6 parts). The batch was prepared by melting DS1227 and EP2 together at 140° C., mixing, then adding EP1 and CHDM. Then, TMPTA (4.5 parts) was added with mixing at 100° C. To this sample was added COM, AMOX, and KB1 followed by mixing at 100° C. Make coat precursors were applied at 125° C. by means of a knife coater to the paper backing at a weight of about 20 g/m$^2$. The sample was then irradiated (3 passes at 18.3 m/min) with one 400 W/cm "D" bulb immediately before P180 AO abrasive particles were electrostatically projected into the make coat precursor at a weight of about 85 g/m$^2$. The intermediate product was thermally cured for 15 minutes at a temperature of 100° C.

A size coat precursor was roll coated over the abrasive grains at a weight of about 50 g/m$^2$. The size coat precursor included a 100% solids blend of EP1 (40 parts), ERL 4221 (30 parts), TMPTA (30 parts), KB1 (1 part), and COM (1 part). The samples were then irradiated (3 passes at 18.3 m/min) with one 400 W/cm "D" bulb followed by a thermal cure for 10 minutes at IOO° C. The sample was supersized at a weight of about 35 g/m$^2$ with a calcium stearate solution (50% solids aqueous calcium stearate/acrylic binder solution) available from Witco Chemical Corporation, Memphis, Tenn.

4. Comparative Sample L

Comparative Article L was prepared by the same methodology as described above for Abrasive Article A using the formulations shown in Table 1.

5. Comparative Samples A, C, G, I, O, AA, CC

Comparative Articles A, C, G, I, O, AA, CC are commercially available from Minnesota Mining and Manufacturing Company, St. Paul, Minn. under trade designation "216U P180 Fre-Cut Production Paper A Weight".

TABLE 1

Formulation of Abrasive Articles

| | Abrasive Article A | Abrasive Article B | Comparative Abrasive Articles B, D, F,, H, J, K, N, P, BB, DD, FF, HH, JJ | Comparative Abrasive Article L |
|---|---|---|---|---|
| Backing type | [a]Paper, C90233 EX | [a]Paper, S-44165 | [a]Paper, 90233 EX | [a]Paper, S-44165 |
| Backing wt. ($g/m^2$) | 95 | 70 | 95 | 20 |
| Make resin type | DS1227(20.7 parts), EP1(30.5 parts), EP2 (33.7 parts), CHDM (2.9 parts), COM(0.6 part), KB1(1.0 part) and AMOX(0.6 parts). | DS1227(20.7 parts), EP1(30.5 parts), EP2(33.7 parts), CHDM (2.9 parts), COM(0.6 part), KB1(1.0 part) and AMOX(0.6 parts). | DS1227(20.7 parts), EP1(30.5 parts), EP2(33.7 parts), CHDM (2.9 parts), COM(0.6 part), KB1(1.0 part) and AMOX(0.6 parts). | DS1227(20.7 parts), EP1(30.5 parts), EP2(33.7 parts), CHDM (2.9 parts), COM(0.6 part), KB1(1.0 part) and AMOX(0.6 parts). |
| Make resin wt. ($g/m^2$) | 20 | 12.5 | 20 | 12.5 |
| Mineral Type | P180 AO | P400 SiC | P180 AO | P400 SiC |
| Mineral Wt. ($g/m^2$) | 85 | 40 | 85 | 40 |
| Size resin Type | EP1/ERL 4221/SR321 (40/30/30) | EP1/ERL 4221/TMTPA (40/30/30) | EP1/ERL 4221/TMTPA (40/30/30) | EP1/ERL 4221/TMTPA (40/30/30) |
| Size Resin wt. ($g/m^2$) | 50 | 35 | 50 | 35 |
| Supersize coating type | none | none | Calcium Stearate/acrylic binder solution (50% solids) | Calcium Stearate/acrylic binder solution (50% solids) |
| Supersize wt. ($g/m^2$) | | | 35 | 20 |

B. Preparation of Binder Percursor Particles for Use in a Supersize Coat

Samples of binder precursor particles according to the present invention were prepared from the formulations in Table 2. To make each sample, the ingredients were either (1) melt blended together, solidified, and ground into a powder or (2) dry blend mixed and ground into powders. The samples were ground into fine powders by mortar and pestle or hammer mill, unless otherwise indicated. A few examples are given below to illustrate the methodology.

1. Preparation of Binder Precursor Particles Comprising a Combination of ZnSt2/CaSt2/EB1/IRG1 (45/45/10/1)

A 0.5 L. jar was charged with 45 g of ZnSt2, 45 g of CaSt2 and 10 g of EB1. The materials were melted at 120–160° C., mixed, and 1 g of IRG1 was added. The material was cooled, and the resultant solid was ground into a fine powder.

2. Preparation of Binder Precursor Particles Comprising a Combination of ZnSt2/UF1(80/20)

A 0.5 L. jar was charged with 80 g of ZnSt2 and 20 g of UF1. The solids were dry blended in a grinder.

3. Preparation of Binder Precursor Particles Comprising a Combination of ZnSt2/CaSt2/EP2/IMID (50/50/14/1)

A 0.5 L. jar was charged with 50 g of ZnSt2, 50 g of CaSt2 and 14 g of EP2, The materials were melted at 120–140° C., mixed, and 1 g of IMID was added. The material was cooled, and the resultant solid was ground into a fine powder.

TABLE 2

Binder Precursor Particles Formulations

| Sample No. | Metal Salt of Fatty Acid/Fatty Acid | Weight of Metal Salt of Fatty Acid (g) | Radiation/ Thermally Curable Component | Weight Radiation/ Thermally Curable Component (g)* |
|---|---|---|---|---|
| Sample 1, 15 & 37 | ZnSt2 | No binder | None | 0 |
| Sample 2, 16 & 38A | ZnSt2 | 88 | EB1 | 12 |
| Sample 3 | ZnSt2 | 85 | EB3 | 15 |
| Sample 4 | ZnSt2 | 85 | EB1 | 15 |
| Sample 5 | ZnSt2 | 85 | EB1 | 7.5 |
| | | | EB3 | 7.5 |
| Sample 6 | ZnSt2 | 70 | EB1 | 7.5 |
| | | | Elvax 310 | 7.5 |
| Sample 7 | ZnSt2 | 95 | EB1 | 5 |
| Sample 8 | ZnSt2 | 95 | EB2 | 5 |
| Sample 9 | ZnSt2 | 95 | EB3 | 5 |
| Sample 10 & 12 | CaSt2 | 90 | EB1 | 10 |
| Sample 11 | CaSt2 | 100 | None | 0 |
| Sample 13 | CaSt2 | 90 | EB3 | 10 |
| Sample 14 | CaSt2 | 90 | EB1 | 10 |
| Sample 17 | CaSt2 | 25 | TRPGDA | 31 |
| Sample 18 | ZnSt2 | 25 | TRPGDA | 57 |
| Sample 19 | CaSt2 | 25 | TRPGDA | 44 |
| Sample 20 | ZnSt2 | 25 | TRPGDA | 45 |
| Sample 21 | LiSt | 25 | TRPGDA | 68 |
| [a]Sample 22 & 26 | 50% CaSt2 50% ZnSt2 | 73.6 | EB1 | 23.4 |

TABLE 2-continued

Binder Precursor Particles Formulations

| Sample No. | Metal Salt of Fatty Acid/Fatty Acid | Weight of Metal Salt of Fatty Acid (g) | Radiation/ Thermally Curable Component | Weight Radiation/ Thermally Curable Component (g)* |
|---|---|---|---|---|
| [b]Sample 23 & 27 | 50% CaSt2<br>50% ZnSt2 | 73.6 | EB1 | 23.4 |
| [a]Sample 24, 28 & 29 | 75% CaSt2<br>25% ZnSt2 | 73.6 | EB1 | 23.4 |
| [b]Sample 25 & 30 | 75% CaSt2<br>25% ZnSt2 | 73.6 | EB1 | 23.4 |
| Sample 31 & 32 | 73% CaSt2<br>27% StA | 89 | EB1 | 10 |
| Sample 33 & 34 | 80% CaSt2<br>20% StA | 89 | EB1 | 10 |
| Sample 35 & 36 | 90% CaSt2<br>10% StA | 89 | EB1 | 10 |
| Sample 38B | 50% CaSt2<br>50% ZnSt2 | 80 | PDAP | 14 |
| Sample 38C | 50% CaSt2<br>50% ZnSt2 | 90 | RSX 29522 | 10 |
| Sample 38D | 50% CaSt2<br>50% ZnSt2 | 90 | Et-TMPTA | 10 |
| Sample 38E | 100% ZnSt2 | 90 | UP4145 | 10 |
| Sample 38F | 100% ZnSt2 | 90 | V1 | 10 |
| Sample 38G | 50% CaSt2<br>50% ZnSt2 | 100 | EP2 | 14 |
| Sample 38H | 100% CaSt2 | 90 | Unirez 2221 | 10 |

[a]Particle size of powder was 45–90 um.
[b]Particle size of powder was 0–45 um.

C. Preparation of Abrasive Articles Comprising Supersize Coat

Binder precursor particle samples 1–38H were dry coated onto Abrasive Articles A and/or B (see Table 3), melted, and then solidified to form supersize coats according to the following procedures. The details of the resultant abrasive articles are disclosed in Table 3.

The binder precursors samples 2–15,16, 22–36, and 38A-38B were respectively coated onto Abrasive Article A or B. Specifically, the binder precursor particles were powder coated at about 7.0 to 23g/m$^2$ onto the abrasive articles by drop coating with a mesh sifter, spray coating with a fluidized or electrostatic fluidized spray gun, or coating with an electrostatic fluidized bed coater. The binder precursor particles were then melted by placing the abrasive article in an oven at a temperature of from about 120° to about 165° C. for about 5-15 minutes. The resultant melt layer was then cured by passing the abrasive article through a UV lamp (1 pass at 7.6 m/min. with 157 w/cm bulb). Adhesive sheeting was attached to the backside of the abrasive article and 10.2 cm or 15.2 cm discs were died out of the abrasive articles. The discs were used for Schiefer or Off hand DA testing, described below.

Supersize coat samples formed from binder precursor particles 1 15, 37 and 38H, respectively, were prepared identically to samples 2–14, 16, 22–36, and 38A, except that the materials were not cured after removing the resultant melt layer form the oven. Adhesive sheeting was attached to the backside of the abrasive article and 10.2 cm or 15.2 cm discs were died out of the abrasive articles. The discs were used for Schiefer or Offhand DA testing, describe below.

Supersize coat samples formed from binder precursor particles 38B–G, respectively, were prepared identically to samples 2–14,16 22–36, and 38A except that the amount of time that the samples were placed in the oven was extended to 30–90 minutes to thermally cure the resultant melt layer. Adhesive sheeting was attached to the backside of the abrasive articles and 10.2 cm or 15.2 cm discs were died out of the abrasive articles. The discs were used for Schiefer tests, described below.

Supersize coat samples formed from binder precursor particles 17–21, respectively, were prepared identically to samples 2–14,16 22–36, and 38A except that, prior to powder coating, a composition comprising 50 g of radiation curable monomer (TRPGDA), 50 g of ethyl acetate and 1 g of initiator (IRG1) were combined and placed in a spray bottle. The solution was sprayed onto 15.2 cm×20.3 cm sections of Abrasive Article A and allowed to air dry. About 8 g/m$^2$ were then applied to the corresponding abrasive article by electrostatic fluidizing spray gun. The abrasive article was then placed in an oven at a temperature in the range of from about 120° to about 165° C. to melt the particles. Finally, the resultant melt layer was cured by passing the abrasive article through a UV lamp (1 pass at 7.6 M/min. with a 157 w/cm bulb). Adhesive sheeting was attached to the backside of the abrasive article and 10.2 cm or 15.2 cm discs were died out of the abrasive articles. The discs were used in testing, described below.

TABLE 3

Samples of Abrasive Articles Powder Coated with Supersize Coat

| Sample No. | Supersize Coat Weight (g/m$^2$) | Abrasive Article | Powder Coat Method |
|---|---|---|---|
| Sample 1–2 | 21.9 | A | Drop coating |
| Sample 3 | 20.7 | A | Drop coating |
| Sample 4–6 | 21.9 | A | Drop coating |
| Sample 7 | 22.6 | A | Drop coating |
| Sample 8–9 | 21.3 | A | Drop coating |
| Sample 10 | 21.3 | A | Drop coating |
| Sample 11 | 22.3 | A | Drop coating |
| Sample 12–14 | 22.6 | A | Drop coating |
| Sample 15 | 7.4 | A | Electrostatic fluidized |

TABLE 3-continued

Samples of Abrasive Articles Powder Coated with Supersize Coat

| Sample No. | Supersize Coat Weight (g/m$^2$) | Abrasive Article | Powder Coat Method |
|---|---|---|---|
| | | | spraying |
| Sample 16 | 16.8 | A | Electrostatic fluidized spraying |
| Sample 17–21 | 8.1 | A | Electrostatic fluidized spraying |
| Sample 22 | 17.4 | A | Electrostatic fluidized bed coating |
| Sample 23 | 19.2 | A | Electrostatic fluidized bed coating |
| Sample 24 | 16.1 | A | Electrostatic fluidized bed coating |
| Sample 25 | 22.3 | A | Electrostatic fluidized bed coating |
| Sample 26 | 8.7 | B | Electrostatic fluidized bed coating |
| Sample 27 | 7.4 | B | Electrostatic fluidized bed coating |
| Sample 28 | 12.4 | B | Electrostatic fluidized bed coating |
| Sample 29 | NA | B | Electrostatic fluidized bed coating |
| Sample 30 | 8.7 | B | Electrostatic fluidized bed coating |
| Sample 31–36 | 22.6 | A | Drop Coating |
| Sample 37–38 | 22.6 | A | Drop Coating |
| Sample 38B | 22.6 | A | Drop Coating |
| Sample 38C | 22.6 | A | Drop Coating |
| Sample 38D | 16.1 | A | Drop Coating |
| Sample 38E | 16.1 | A | Drop Coating |
| Sample 38F | 16.1 | A | Drop Coating |
| Sample 39G | 16.1 | A | Drop Coating |
| Sample 39H | 16.1 | A | Drop Coating |

D. Evaluation of Abrasive Articles Comprising a Supersize Coat

1. Test Procedures a. Schiefer Testing Procedure

Each 10.2 cm diameter disc of the abrasive articles of each Sample 1–38H and Comparative Samples A–O and AA–JJ(See Tables 4–7) was secured to a foam back-up pad by means of a pressure sensitive adhesive. Each coated abrasive disc and back-up pad assembly was installed on a Schiefer testing machine, and the coated abrasive disc was used to abrade a cellulose acetate butyrate polymer of predetermined weight. The load was 4.5 kg. The test was considered complete after 500 revolution cycles of the coated abrasive disc. The cellulose acetate butyrate polymer was then weighed, and the amount of cellulose acetate butyrate polymer removed was recorded. The results of the test procedures are tabulated hereinbelow with the appropriate Comparative Samples. Briefly, the results illustrated below in Tables 4–7 illustrated that supersize coats derived from radiation curable binder precursor particles, thermal curable binder precursor particles and thermoplastic binder precursor particles exhibited superior performance to conventional aqueous calcium stearate/acrylic binder supersize coats. In addition to the superior performance, these binder precursor particles for supersize coats have environmental and processing advantages over conventional supersize coats prepared from solvent-containing solutions.

TABLE 4A

Schiefer Testing of Samples 1–6 and Comparative Samples A and B

| Sample No. | Cut (g) | Comparative Ranking Relative to A | Comparative Ranking Relative to B |
|---|---|---|---|
| Comparative A | 3.324 | 100 | 106 |
| Comparative B | 3.150 | 95 | 100 |
| Sample 1 | 3.362 | 101 | 107 |
| Sample 2 | 3.052 | 92 | 97 |
| Sample 3 | 3.218 | 97 | 102 |
| Sample 4 | 3.024 | 91 | 96 |
| Sample 5 | 2.818 | 85 | 89 |
| Sample 6 | 2.803 | 84 | 89 |

TABLE 4B

Schiefer Testing of Samples 7–11 and Comparative Samples C and D

| Sample No. | Cut (g) | Comparative Ranking Relative to C | Comparative Ranking Relative to D |
|---|---|---|---|
| Comparative C | 3.195 | 100 | 115 |
| Comparative D | 2.776 | 87 | 100 |
| Sample 7 | 2.846 | 89 | 102 |
| Sample 8 | 3.208 | 100 | 116 |
| Sample 9 | 3.118 | 98 | 112 |
| Sample 10 | 3.391 | 106 | 122 |
| Sample 11 | 3.421 | 107 | 123 |

TABLE 4C

Schiefer Testing of Samples 12–14 and Comparative Samples E and F

| Sample No. | Cut (g) | Comparative Ranking Relative to E | Comparative Ranking Relative to F |
|---|---|---|---|
| Comparative E | 3.016 | 100 | 91 |
| Comparative F | 3.317 | 110 | 100 |
| Sample 12 | 3.495 | 116 | 105 |
| Sample 13 | 3.392 | 112 | 102 |
| Sample 14 | 3.596 | 119 | 108 |

TABLE 5A

Schiefer Testing of Samples 15–16 and Comparative Samples G and H

| Sample No. | Cut (g) | Comparative Ranking Relative to G | Comparative Ranking Relative to H |
|---|---|---|---|
| Comparative G | 2.849 | 100 | 90 |
| Comparative H | 3.176 | 111 | 100 |
| Sample 15 | 3.060 | 107 | 96 |
| Sample 16 | 2.824 | 99 | 90 |

TABLE 5B

Schiefer Testing of Samples 17–21 and Comparative Samples I and J

| Sample No. | Cut (g) | Comparative Ranking Relative to I | Comparative Ranking Relative to J |
|---|---|---|---|
| Comparative I | 3.173 | 100 | 96 |
| Comparative J | 3.291 | 104 | 100 |
| Sample 17 | 2.901 | 91 | 88 |
| Sample 18 | 2.349 | 74 | 71 |
| Sample 19 | 3.046 | 96 | 92 |
| Sample 20 | 2.345 | 74 | 71 |
| Sample 21 | 2.157 | 68 | 65 |

TABLE 6

Schiefer Testing for Samples 22–30 and Comparative Samples K and L

| Sample No | Cut (g) | Comparative Ranking Relative to K |
|---|---|---|
| Comparative K | 2.990 | 100 |
| Sample 22 | 3.183 | 106 |
| Sample 23 | 3.159 | 105 |
| Sample 24 | 3.632 | 121 |
| Sample 25 | 3.641 | 122 |
| | | Comparative Ranking Relative to L |
| Comparative L | 1.000 | 100 |
| Sample 26 | 1.196 | 120 |
| Sample 27 | 0.955 | 96 |
| Sample 28 | 1.237 | 124 |
| Sample 29 | 1.242 | 124 |
| Sample 30 | 1.191 | 119 |

TABLE 7A

Schiefer Testing for Samples 31–36 and Comparative Sample N

| Sample No. | Cut (g) | Comparative Ranking Relative to N |
|---|---|---|
| Comparative N. | 2.469 | 100 |
| Sample 31 | 2.741 | 111 |
| Sample 32 | 2.472 | 100 |
| Sample 33 | 3.142 | 127 |
| Sample 34 | 3.347 | 136 |
| Sample 35 | 3.218 | 130 |
| Sample 36 | 3.597 | 145 |

TABLE 7B

Schiefer Testing for Samples 38B–38D and Comparative Sample BB, DD and FF

| Sample No. | Cut (g) | |
|---|---|---|
| | | Comparative Ranking Relative to BB. |
| Comparative BB | 2.916 | 100 |
| Sample 38B | 3.408 | 117 |
| | | Comparative Ranking Relative to DD |
| Comparative DD | 2.932 | 100 |
| Sample 38C | 3.236 | 110 |
| | | Comparative Ranking Relative to FF |
| Comparative FF | 2.756 | 100 |
| Sample 38D | 3.219 | 117 |

TABLE 7C

Schiefer Testing for Samples 38E–38H and Comparative Samples HH, JJ and AA

| Sample No. | Cut (g) | |
|---|---|---|
| | | Comparative Ranking Relative to HH. |
| Comparative HH | 2.720 | 100 |
| Sample 38E | 3.013 | 111 |
| Sample 38F | 2.936 | 108 |
| | | Comparative Ranking Relative to AA |
| Comparative AA | 2.346 | 100 |

TABLE 7C-continued

Schiefer Testing for Samples 38E–38H and Comparative Samples HH, JJ and AA

| Sample No. | Cut (g) | |
|---|---|---|
| Sample 38G | 2.764 | 118 |
| | | Comparative Ranking Relative to JJ |
| Comparative KK | 3.323 | 100 |
| Sample 38H | 3.717 | 112 |

2. Offhand DA Test Method

A paint panel, that is, a steel substrate with an e-coat, primer, base coat, and clear coat typically used in automotive paints, was abraded in each case with coated abrasives made in accordance with the invention and with coated abrasives as comparative examples. Each coated abrasive had a diameter of 15.2 cm and was attached to a random orbital sander (available under the trade designation "DAQ", from National Detroit, Inc., Rockford, Ill.). The abrading pressure was about 0.2 kg/cm$^2$, while the sander operated at about 60 PSI@TOOL (413 kPa). The painted panels were purchased from ACT Company of Hillsdale, Mich. The cut in grams was computed in each case by weighing the primer-coated substrate before abrading and after abrading for a predetermined time, for example, 1 or 3 minutes. The DA test data for samples 37, 38A, and Comparative Samples O and P are shown in Table 8.

TABLE 8

DA Testing (3 min.) for Samples 37, 38A and Comparative Sample O and P

| Sample No. | Cut | Ranking Relative to Comparative Abrasive Article O | Ranking Relative to Comparative Abrasive Article P |
|---|---|---|---|
| Comparative O | 11.7 | 100 | 101 |
| Comparative P | 11.6 | 99 | 100 |
| Example 37 | 10.15 | 87 | 88 |
| Example 38A | 11.75 | 100 | 101 |

EXAMPLE II

Preparation of Abrasive Articles Comprising a Backing Layer and Abrasive Coating Comprising a Size Coat A. Preparation of Abrasive Articles Comprising a Backing Layer and Abrasive (Table 9)

1. Abrasive Article C

These abrasive articles used a backing that was a 95 g/m$^2$ paper backing C90233 EX commercially available from Kimberly-Clark, Neenah, Wis. To make each, a make coat precursor was prepared from DS1227 (20.7 parts), EP1 (30.5 parts), EP2 (33.7 parts), CHDM (2.9 parts), COM (0.6 part), KB1 (1.0 part) and AMOX (0.6 parts). The batch was prepared by melting DS1227 and EP2 together at 140° C., mixing, and then adding EP1 and CHDM and mixing. Then, TMPTA (4.5 parts) was added with mixing at 100° C. To this sample was added COM, AMOX, and KB1 followed by mixing at 100° C. The make coat precursor was applied at 125° C. by means of a knife coater to the paper backing at a weight of about 20 g/m$^2$. The sample was then irradiated (3 passes at 18.3 m/min) with one 400 W/cm "D" bulb immediately before P180 AO abrasive particles were electrostatically projected into the make coat precursor at a weight of about 85 g/m$^2$. The intermediate product was thermally cured for 15 minutes at a temperature of 100° C.

2. Abrasive Article D

An abrasive article used a 5 mil thick polyester backing that can be obtained commercially from Minnesota Mining and Manufacturing Company, St. Paul, Minn. A make coat precursor comprising an aqueous solution of UF2, a 75% solid aqueous resole phenolic resin with a formaldehyde/phenol ratio of approximately 1.1–3.0/1 and a pH of 9, ACL and PTSOH (85/15/2/1) was roll coated onto the backing at an approximate weight of 40 g/m$^2$. Next, a blend of P180 and AlO/CUB abrasive particles (50–90/10–50) was electrostatically projected into the make coat precursor at a weight of about 155 g/m$^2$. The make resin was cured in an oven at 100° C. for 60 minutes.

3. Comparative Samples Q and R

These abrasive articles used a backing that was a 95 g/m$^2$ paper backing C90233 EX commercially available from Kimberly-Clark, Neenah, Wis. To make each article, a make coat precursor was prepared from DS1227 (20.7 parts), EP1 (30.5 parts), EP2 (33.7 parts), CHDM (2.9 parts), COM (0.6 part), KB1 (1.0 part) and AMOX (0.6 parts). The batch was prepared by melting DS1227 and EP2 together at 140° C., mixing, and then adding EPI and CHDM. Then, TMPTA (4.5 parts) was added with mixing at 100° C. To this sample was added COM, AMOX, and KB1 followed by mixing at 100° C. Make coat precursors were applied at 125° C. by means of a knife coater to the paper backing at a weight of about 20 g/m$^2$. The sample was then irradiated (3 passes at 18.3 m/min) with one 400 W/cm "D" bulb immediately before P180 AO abrasive particles were electrostatically projected into the make coat precursor at a weight of about 85 g/m$^2$. The intermediate product was thermally cured for 15 minutes at a temperature of 100° C.

A size coat precursor was roll coated over the abrasive grains at a weight of about 50 g/m$^2$. The size coat precursor included a 100% solids blend of EP1 (40 parts), ERL 4221 (30 parts), TMPTA (30 parts), KB1 (1 part), and COM (1 part). The samples were then irradiated (3 passes at 18.3 m/min) with one 400 W/cm "D" bulb followed by a thermal cure for 10 minutes at 100° C.

4. Comparative Abrasive Articles S,T,U,V

An abrasive article used a 5 mil thick polyester backing with a backing that can be obtained commercially from Minnesota Mining and Manufacturing Company, Paul, Minn. A make coat precursor comprising an aqueous solution of UF2, a 75% solid aqueous resole phenolic resin with a with a formaldehyde/phenol ratio of approximately 1.1–3.)/1 and pH of 9, ACL, and PTSOH (85/15/2/1) was roll coated onto the backing at an approximate weight of 40 g/m$^2$. Next, a blend of P180 and AlO/CUB abrasive particles (50–90/10–50) was electrostatically projected into the make coat precursor at a weight of about 155g/m$^2$. The make resin was cured in an oven at 93 C for 30 minutes. Next, a size coat precursor comprising a 75% solids aqueous solution of resole phenolic resin with a formaldehyde/phenol ratio of approximately 1.1–3.0/1, pH of 9 and feldspar (70/35) was coated onto the make coat at an approximate weight of 200 g/m$^2$. The size resin was cured by placing the sample in an oven at 100–110° C. for 1–2 hours.

The formulations for Abrasive Articles C and D and Comparative Abrasive Articles Q–V are shown below in Table 9.

TABLE 9

Formulation of Abrasive Articles

| | Abrasive Article C | Abrasive Article D | Comparative Abrasive Articles Q,R | Comparative Abrasive Articles S,T,U,V |
|---|---|---|---|---|
| Backing type | [a]C90233 EX | [b]Polyester film | [a]C90233 EX | [b]Polyester film |
| Backing wt. (g/m$^2$) | 95 | 5 mil | 95 | 5 mil |
| Make resin type | DS1227 (20.7 parts), EP1 (30.5 parts), EP2 (33.7 parts), CHDM (2.9 parts), COM (0.6 part), KB1 (1.0 part) and AMOX (0.6 parts). | UF2/Resole phenolic resin/ACL/PTSOH (85/15/12/1) | DS1227 (20.7 parts), EP1 (30.5 parts), EP2 (33.7 parts), CHDM (2.9 parts), COM (0.6 part), KB1 (1.0 part) and AMOX (0.6 parts). | UF2/Resole phenolic resin/ACL/PTSOH (85/15/12/1) |
| Make resin wt. (g/m$^2$) | 20 | 40 | 20 | 40 |
| Mineral Type | P180 AO | P180 AO/CUB (50–90/10–50) | P180 AO | P180 AO/CUB (50–90/10–50) |
| Mineral Wt. (g/m$^2$) | 85 | 155 | 85 | 155 |
| Size resin Type | none | | EP1/ERL 4221/TMPTA (40/30/30) | Resole Phenolic resin filled with 35% FLSPR |
| Size Resin wt. (g/m$^2$) | none | | 50 | 200 |

[a]Commercially available from Kimberly-Clark, Neenah, WI
[b]Commercially available from Minnesota Mining and Manufacturing Company, St. Paul, MN B. Preparation of Radiation Curable Binders 1. p-Di(acryloyloxyethyl)Terephthalate (PDAP)

To a 2 liter, 3-necked round bottomed flask equipped with a dropping addition funnel, thermometer, ice bath and paddle stirrer was added 500 ml of dry tetrahydrofuran (THF), 103 g (1.02 mol) of triethylamine and 117 g (1 mol) of 2-Hydroxyethylacrylate. Stirring was begun. To the dropping addition funnel was added a solution of 102.5 g (0.5 mol, plus slight excess) terephthaloyl chloride in 500 ml of dry THF. This solution was added to the reaction vessel contents such that the temperature of the contents did not exceed 30° C. When the addition was completed, the reaction was stirred for an hour longer at ambient temperature and filtered through a sintered Buchner-type funnel. The formed triethylamine hydrochloride was rinsed thoroughly with dry THF, and discarded. The THF solution was concentrated on a rotoevaporator, using a 60° C. water bath, until the volume of solvent was reduced by approximately one half. Then, the concentrate was quenched with twice its volume in heptane and triturated. The solid product quickly precipitated. The pasty solid was cooled to ambient temperature and filtered. The cake was rinsed with additional heptane and spread out to dry in a glass cake pan. Isolated yield: 85–90% of theoretical. The product was found to have a $T_m$ of about 97° C., by DSC. Thin layer chromatography showed the product to be pure, as evidenced by a single spot (elution solvent of 10% methanol/90% chloroform, using F254 silica gel coated glass plates). The infrared spectrum showed a characteristic ester peak at 1722 $cm^{-1}$.

2. O-Acrylated Novolak (PAN)

To a 1 liter, 3-necked round bottomed flask equipped with a paddle stirrer, thermometer, ice bath and a dropping addition funnel was added 200 g of Borden SD-7280 phenolic novolak resin, followed by 400 ml of dry tetrahydrofuran (THF). Stirring was begun. When solution was obtained, 52.6 g (0.52 mol) of triethylamine was added. The contents of the flask were cooled to 10° C. To the dropping addition funnel were added 45.3 g (0.5 mol) of acryloyl chloride. This acid chloride was added to the novolak solution over 30 minutes, at such a rate that allowed the temperature of the contents to rise to ambient. The triethylamine hydrochloride readily formed. The contents were stirred for an additional 2 hours at ambient temperature, then filtered. The filter cake was rinsed with dry THF and concentrated to a viscous, resinous-like syrup on a rotoevaporator, while heating the concentrate to 70° C. The resinous product was transferred to a glass jar, with gentle heating of the flask walls to aid in its flow. NMR analysis of this resin showed some traces of triethylamine hydrochloride still present, and approximately 10 weight percent of THF. The main product showed approximately 0.2 mol of acrylate ester per ring of phenol. The novolak had a calculated formaldehyde to phenol ratio of about 0.8

3. Acrylamidomethyl Novolak (AMN)

AMN was prepared as described in U.S. Pat. Nos. 4,903,440 and 5,236,472.

C. Preparation of Radiation Curable Binder Precursor Particles for Use in Size Coat (See Table 10 for Formulation Summary)

1. Preparation of Binder Precursor Particles Comprising a Combination of AMN/PDAP/CAB-O-SIL/IRG1 (50/50/0.2/2)

A 0.5 L. jar was charged with 100 g of AMN (a viscous liquid), 100 g of PDAP and 0.4 g of CAB-O-SIL. The sample was heated to 110–115° C. for 30 minutes and mixed. Next, 4 g of IRG1 was added to the molten mixture, mixed and cooled to room temperature. The resulting solid was ground into a fine powder with a grinder.

2. Preparation of Binder Precursor Particles Comprising of a Combination of PAN/PDAP/IRG1/MOD (50/50/2/0.2)

A 0.25 L. jar was charged with 25 g of a viscous liquid ,PAN, and 25g of PDAP. The sample was heated to 110–115° C. for 30 minutes and mixed. Next, 1 g. of IRG1 and 0.1 g of MOD was added to the molten mixture, mixed and cooled to room temperature. The resulting solid was ground into a fine powder with a grinder. The addition of liquid nitrogen to the cooling solid aided in grinding.

3. Preparation of Binder Precursor Particles Comprising a Combination of AMN/PDAP/CRY/IIRG(50/50/100/2)

A 0.5 L jar was charged with 50 g of AMN (a viscous liquid), 50 g of PDAP, and 100 g of CRY The sample was heated to 110–115° C. for 30 minutes and mixed. Next, 2 g of IRG1 was added to the molten mixture, mixed and cooled to room temperature. The resulting solid was ground into a fine powder.

4. Preparation of Binder Precursor Particles Comprising a Combination of EP1/EP2/SD 7280/COM (20/60/20/1)

A 0.5 L jar was charged with 20 g of EP 1, 60 g of EP2, and 20 g of SD 7280. The sample was heated to 120° C. for 60 minutes and mixed. Next, 1 g of COM was added to the molten mixture, mixed and cooled to room temperature. The resulting solid was ground into a fine powder.

5. Preparation of Binder Precursor Particles Comprising a Combination of EP1/EP2/SD 7280/CRY/COM (20/60/20/100/2)

A 0.5 L jar was charged with 20 g of EP1 (a viscous liquid), 60 g of EP2, 20 g of SD 7280 and 100 g of CRY. The sample was heated to 120° C. for 60 minutes and mixed. Next, 2 g of COM was added to the molten mixture, mixed and cooled to room temperature. The resulting solid was ground into a fine powder with a grinder.

6. Preparation of Binder Precursor Particles Comprising a Combination of PT60/COM (100/1)

A 0.5 Ljar was charged with 100 g of PT-60 and heated to 90° C. 1 g of COM was added, and the resultant solid was cooled to room temperature. The solid was ground into a fine powder with a grinder.

7. Preparation of Binder Precursor Particles Comprising a Combination PT60/CRY/IRG1 (50/50/1)

A 0.5 L jar was charged with 50 g of 100/1 PT60/COM solid. Next 50 g of CRY was added. The two solids were mixed and ground into a fine powder with a grinder.

8. Preparation of Binder Precursor Particles Comprising a Combination EP2/PDAP/IRG1/COM (70/30/1/1)

A 0.5 L. jar was charged with 70 g EP1 (a solid embodiment), and 30 g PDAP. The sample was heated to 110–115° C. for 30 minutes and mixed. Next, 1 g of IRG1 and 1 g of COM was added to the molten mixture, mixed and cooled to room temperature. The resulting solid was ground into a fine powder with a grinder.

9. Preparation of Binder Precursor Particles Comprising a Combination EP2/PDAP (70/30/4/2/1/1)

A 0.5 L. jar was charged with 70 g of (EP2), as solid, 30 g of (PDAP), 4g of CaSt2, and 2g of ZnSt2. The sample was heated to 110–115° C. for 30 minutes and mixed. Next, 1 g of IRG1 and 1 g of COM was added to the molten mixture, mixed and cooled to room temperature. The resulting solid was ground into a fine powder with a grinder.

TABLE 10

Binder Precursor Particle Formulations

| Sample No. | Formulation |
|---|---|
| Sample 39 | AMN/PDAP/CAB-O-SIL/IRG1(50/50/0.2/2) |
| Sample 40 | PAN/PDAP/IRG1/MOD(50/50/2/0.2) |
| Sample 41 | AMN/PDAP/CRY/IRG1(50/50/100/2) |
| Sample 42 | EP1/EP2/SD 7280/COM(20/60/20/1) |
| Sample 43 | EP1/EP2/SD 7280/CRY/COM(20/60/20/100/2) |
| Sample 44 | PT60/COM(100/1) |
| Sample 45 | PT60/CRY/COM(100/100/1) |
| Sample 46 | EP2/PDAP/IRG1/COM(70/30/1/1) |
| Sample 47 | EP2/PDAP(70/30/4/2/1/1) |
| Sample 48 | EP1/EP2/SD 7280/COM(38.5/38.5/23/1) |

TABLE 10-continued

| Binder Precursor Particle Formulations | |
|---|---|
| Sample No. | Formulation |
| Sample 49 | DZ1 |
| Sample 50 | DZ2 |

D. Preparation of Abrasive Articles Comprising a Size Coat

Binder precursor particles sample 39–50 were coated onto one or more of Abrasive Articles C and D to form size coats according to the following procedure.

The binder precursor particle samples 39–46 and 48 were coated onto Abrasive Article D, while binder precursor particle sample 45 and 47 were coated onto Abrasive Article C. Specifically, the binder precursor particles were powder coated onto the abrasive articles at 30 to 160 g/m$^2$ by drop coating with a mesh sifter. The binder precursor particles were then melted by placing the abrasive article in an oven at a temperature in the range from about 120° C. to about 165° C. for 5–15 minutes. The size coat was then cured by passing the abrasive through a UV lamp (1 pass at 7.6 m/min. with a 157 w/cm bulb). Samples 46 and 47 were placed in an oven for 10 minutes at 100° C. Adhesive sheeting was attached to the abrasive articles and 10.2 cm discs were died out of the abrasive articles.

The binder precursor particle samples 49,and 50 were coated onto Abrasive Article C. Specifically, the binder precursor particles were powder coated onto the abrasive articles by drop coating with a mesh sifter. The abrasive samples were placed in an oven at a temperature in the range from about 105° C. to about 140° C. for about 2 hours. Adhesive sheeting was attached to the abrasive articles and 10.2 cm discs were died out of the abrasive articles.

The details of the resultant abrasive articles are disclosed in Table 11, hereinbelow. All discs were used for Schiefer testing, described below.

TABLE 11

| Abrasive Articles Comprising Size Coat | | | |
|---|---|---|---|
| Sample No. | Size Coat Weight (g/m$^2$) | Abrasive Article | Powder Coat Method |
| Sample 39 | 120 | D | Drop Coat |
| Sample 40 | 120 | D | Drop Coat |
| Sample 41 | 171 | D | Drop Coat |
| Sample 42 | 123 | D | Drop Coat |
| Sample 43 | 165 | D | Drop Coat |
| Sample 44 | 123 | D | Drop Coat |
| Sample 45 | 160 | D | Drop Coat |
| Sample 46A | 58.1 | C | Drop Coat |
| Sample 46B | 42.0 | C | Drop Coat |
| Sample 47A | 61.3 | C | Drop Coat |
| Sample 47B | 45.2 | C | Drop Coat |
| Sample 48 | 123 | D | Drop Coat |
| Sample 49A | 42.0 | C | Drop Coat |
| Sample 49B | 40.4 | C | Drop Coat |
| Sample 50A | 42.0 | C | Drop Coat |
| Sample 50B | 32.3 | C | Drop Coat |

E. Evaluation of Abrasive Articles Comprising a Size Coat

1. Schiefer Test Procedure

Each 10.2 cm diameter disc of the abrasive articles of each Sample 39–50 and Comparative Samples R-V (See Table 11) was secured to a foam back-up pad by means of a pressure sensitive adhesive. Each coated abrasive disc and back-up pad assembly were installed on a Schiefer testing machine, and the coated abrasive disc was used to abrade a properly sized cellulose acetate butyrate polymer of predetermined weight. The load was 4.5 kg. The test was considered completed after 500 revolution cycles of the coated abrasive disc. The cellulose acetate butyrate polymer was then weighed, and the amount of cellulose acetate butyrate polymer removed was recorded. The results of the test procedure are tabulated hereinbelow along with results for the appropriate Comparative Samples. Briefly, the results illustrated in Tables 12–13 illustrated that size coats derived from radiation curable binder precursor particles exhibited superior performance to conventional phenolic size coats. In addition to the superior performance, these binder precursor particles for size coats have environmental and processing advantages over conventional coatings.

Tables 12A, 12B, and 13 show the results of Scheifer Testing for Samples 39–50B and Comparative Samples Q–V.

TABLE 12A

| Schiefer Testing for Samples 39–45, 48 and Comparative Samples S, T, U, V | | |
|---|---|---|
| Sample No. | Cut (g) | |
| | | Comparative Ranking Relative to S |
| Comparative S | 2.964 | 100 |
| Sample 41 | 3.252 | 110 |
| Sample 39 | 3.211 | 108 |
| | | Comparative Ranking Relative to T |
| Comparative T | 3.216 | 100 |
| Sample 44 | 3.699 | 115 |
| Sample 45 | 3.663 | 114 |
| | | Comparative Ranking Relative to U |
| Comparative U | 3.421 | 100 |
| Sample 42 | 3.776 | 109 |
| Sample 48 | 3.831 | 110 |
| | | Comparative Ranking Relative to V |
| Comparative V | 3.556 | 100 |
| Sample 43 | 4.029 | 113 |
| Sample 40 | 2.204 | 62 |

TABLE 12B

| Schiefer Testing for Samples 46–47 and Comparative Samples R | | |
|---|---|---|
| Sample No. | Cut (g) | Comparative Ranking Relative to R |
| Comparative Q | 1.117 | 100 |
| Sample 46A | 0.689 | 58 |
| Sample 46B | 0.674 | 57 |
| Sample 47A | 1.425 | 121 |
| Sample 47B | 1.465 | 124 |

TABLE 13

| Schiefer Testing for Samples and Comparative Samples Q | | |
|---|---|---|
| Sample No. | Cut (g) | Comparative Ranking Relative to Q |
| Comparative R | 1.223 | 100 |
| Sample 49A | 1.126 | 92 |
| Sample 49B | 1.289 | 105 |
| Sample 50A | 1.005 | 82 |
| Sample 50B | 0.793 | 65 |

EXAMPLE III

Preparation of Abrasive Article Comprising a Backing Layer and an Abrasive Coating Comprising a Make Coat A. Preparation of Abrasive Articles Comprising a Backing Layer and Abrasive 1. Comparative Abrasive Article W Abrasive articles used a backing that was a 95 g/m$^2$ paper backing C90233 EX commercially available from Kimberly-Clark, Neenah, Wis. A make coat precursor was prepared from DS1227 (20.7 parts), EP1 (30.5 parts), EP2 (33.7 parts), CHDM (2.9 parts), COM (0.6 part), KB1 (1.0 part) and AMOX (0.6 parts). The batch was prepared by melting DS1227 and EP2 together at 140° C., mixing, and then adding EP1 and CHDM followed by further mixing. Then, TMPTA (4.5 parts) was added with mixing at 100° C. To this sample was added COM, AMOX, and KB1 followed by mixing at 100° C. The make coat precursor was applied at 125° C. by means of a knife coater to the paper backing at a weight of about 30 g/m$^2$. The sample was then irradiated (3 passes at 18.3 m/min) with one 400 W/cm "D" bulb immediately before P180 AO abrasive particles were electrostatically projected into the make coat precursor at a weight of about 85 g/m$^2$. The intermediate product was thermally cured for 15 minutes at a temperature of 100° C.

A size coat precursor was roll coated over the abrasive grains at a wet weight of about 50 g/m$^2$. The size coat precursor included a 100% solids blend of EP1 (40 parts), ERL 4221 (30 parts), TMPTA (30 parts), KB1 (1 part), and COM (1 part). The sample was then irradiated (3 passes at 18.3 m/min) with one 400 W/cm "D" bulb followed by a thermal cure for 10 minutes at 100° C.

B. Preparation of Binder Precursors Particles for Use in a Make Coat

1. Preparation of Binder Precursor Particles Comprising a Combination of PDAP/IRG1 (100/1)

A 0.5 L. jar was charged with 100 g of PDAP. The sample was heated to 110–115° C. for 30 minutes and mixed. Next, 1 g. of IRG1 was added to the molten mixture, mixed and cooled to room temperature. The resulting solid was ground into a fine powder with a grinder.

2. Preparation of Binder Precursor Particles Comprising a Combination of AMN/PDAP/IRG1 (70/30/1)

A 0.5 L. jar was charged with 70 g of AMN (a viscous liquid) and 30 g of PDAP. The sample was heated to 110–115° C. for 30 minutes and mixed. Next, 1 g of IRG1 was added to the molten mixture, mixed and cooled to room temperature. The resulting solid was ground into a fine powder with a grinder.

3. Preparation of Binder Precursor Particles Comprising a Combination of PAN/PDAP/IRG1 (50/50/1)

A 8oz. jar was charged with 25 g of, a viscous liquid PAN and 25 g of PDAP. The sample was heated to 110–115° C. for 30 minutes and mixed. Next, 1 g. of IRGACURE 651 was added to the molten mixture, mixed and cooled to room temperature. The resulting solid was ground into a fine powder with a grinder.

4. Preparation of Binder Precursor Particles Comprising a Combination of EP2/PDAP/IRG 1 /COM/(70/30/1/1)

A 0.5 L. jar was charged with 70 g EP2, a solid, and 30 g of PDAP. The sample was heated to 110–115° C. for 30 minutes and mixed. Next, 1 g of IRG1 and 1 g of COM was added to the molten mixture, mixed and cooled to room temperature. The resulting solid was ground into a fine powder with a grinder

TABLE 14

Binder Precursor Particle Formulations

| Sample No. | Formulations |
|---|---|
| Sample 51A | PDAP/IRG1 (100/10 |
| Sample 51B | PDAP/IRG1 (100/10 |
| Sample 52A | AMN/PDAP (70/30/1) |
| Sample 52B | AMN/PDAP (70/30/1) |
| Sample 53A | EP2/PDAP/COM/IRG1 (70/30/1/1) |
| Sample 53B | EP2/PDAP/COM/IRG1 (70/30/1/1) |
| Sample 54A | PAN/PDAP/IRG1 (50/50/1) |
| Sample 54B | PAN/PDAP/IRG1 (50/50/1) |

C. Preparation of Abrasvive Articles Comprising a Make Coat

Binder precursor particle samples 51–54 were drop coated onto paper backing EX C90233 which is commercially available from Kimberly-Clark, Neenah, Wis. The specific make weights can be found in Table 15. Next, the binder precursor particles were melted onto the backing in an oven at 100–140° C., and P180 AO mineral was drop coated onto the make coat at a weight of 115 g/m$^2$. The sample was then irradiated (3 passes at 18.3 m/min) with one 400 W/cm "D" bulb.

A size coat precursor was roll coated over the abrasive grains at a wet weight of about 100 g/m$^2$. The size coat precursor included a 100% solids blend of EP1 (40 parts), ERL 4221 (30 parts), TMPTA (30 parts), KB1 (1 part), and COM (1 part). The sample was then irradiated (3 passes at 18.3 m/min) with one 400 W/cm "D" bulb followed by a thermal cure for 10 minutes at 100° C.

TABLE 15

Abrasive Articles Comprising a Make Coat

| Sample No. | Make Coat (g/m$^2$) |
|---|---|
| Sample 51A | 16.8 |
| Sample 51B | 14.9 |
| Sample 52A | 20 |
| Sample 52B | 15.0 |
| Sample 53A | 17.1 |
| Sample 53B | 16.8 |
| Sample 54A | 17.2 |
| Sample 54B | 16.9 |

D. Evaluation of Abrasive Articles Comprising a Make Coat

1. Test Procedures a. Schiefer Testing Procedure

The coated abrasive article for each example was converted into a 10.2 cm diameter disc and secured to a foam back-up pad by means of a pressure sensitive adhesive. The coated abrasive disc and back-up pad assembly were installed on a Schiefer testing machine, and the coated abrasive disc was used to abrade a cellulose acetate butyrate polymer. The load was 4.5 kg. The endpoint of the test was 500 revolutions or cycles of the coated abrasive disc. The amount of cellulose acetate butyrate polymer removed is recorded.

As illustrated in Table 16, radiation curable binder precursor particles show utility as make coats, especially when the oligomeric material has hydroxyl functionality, for example, AMN and EP2.

TABLE 16

Schiefer Testing
Abrasive Articles Comprising A Make Coat

| Sample No | Cut (g) | Ranking Relative to Comparative Abrasive Article W |
|---|---|---|
| Comparative W | 1.042 | 100 |
| Sample 51A | 0.036 | 3 |
| Sample 51B | 0.423 | 41 |
| Sample 52A | 0.840 | 81 |
| Sample 52B | 0.787 | 76 |
| Sample 53A | 0.862 | 83 |
| Sample 53B | 0.946 | 91 |
| Sample 54A | 0.386 | 37 |
| Sample 54B | 0.630 | 60 |

EXAMPLE IV

Preparation of Abrasive Article Comprising a Backing Layer and Abrasive Coating Comprising a Grinding Aid Supersize Coat A. Preparation of Abrasive Articles Comprising a Backing Layer and Abrasive 1. Abrasive Article E Abrasive articles used a backing that was a 1080 g/m$^2$ fiber disk (17.8 cm diameter disc) commercially available from Kimberly-Clark, Neenah, Wis. For each, a make coat precursor was prepared from a 75% solids aqueous solution of a phenolic resole (formaldehyde/phenolic ratio of 1.1–3.0/1, pH of about 9), $CaCO_2$ and FEO (50/50/2). The make coat precursor was applied to the backing with a paint brush. Next, grade 50 AZ mineral was electrostatically projected into the make coat precursor at a weight of about 685 g/m$^2$. The intermediate product was thermally cured for 45 minutes at a temperature of 90° C.

A size coat precursor was applied with a paint brush at a weight of 405 g/m$^2$. The size coat precursor was prepared from a 75% solids aqueous solution of a phenolic resole (formaldehyde/phenolic ratio of 1.1–3.0/1, pH of about 9), CRY, and FEO (50/60/2)

The sample was cured thermally for 6 hours at 115° C.

2. Comparative Sample X

Abrasive articles used a backing that was a 1080 g/m$^2$ fiber disk (17.8 cm diameter disc) commercially available from Kimberly-Clark, Neenah, Wis. A make coat precursor was prepared from a 75% solids aqueous solution of a phenolic resole (formaldehyde/phenolic ratio of 1.1–3.0/1, pH of about 9), $CaCO_2$ and FEO (50/50/2). The make coat precursor was applied to the backing with a paint brush. Next, grade 50 AZ mineral was electrostatically projected into the make coat precursor at a weight of about 685 g/m$^2$. The intermediate product was thermally cured for 45 minutes at a temperature of 90° C.

A size coat precursor was applied with a paint brush at a weight of 405 g/m$^2$. The size coat precursor was prepared from a 75% solids aqueous solution of a phenolic resole (formaldehyde/phenolic ratio of 1.1–3.0/1, pH of about 9), CRY, and FEO (50/60/2) The sample was cured thermally for 6 hours at 115° C.

B. Preparation of Binder Precursor Particles for Use Grinding Aid Supersize Coat 1. Preparation of Binder Precursor Particles Comprising a Combination of PDAP/KBF4/ZnSt2/IRG1 (30/60/10/1) (Table 17)

A 0.5 L. jar was charged with 30 g of PDAP, 60 g of KBF4, and 10 g of ZnSt2. The sample was heated to 110–115° C. for 30 minutes and mixed. Next, 1 g. of IRG1 was added to the molten mixture, mixed and cooled to room temperature. The resulting solid was ground into a fine powder with a grinder.

TABLE 17

Binder Precursor Particle Formulation

| Sample No. | Formulations |
|---|---|
| Sample 55 | PDAP/KBF4/ZnSt2/IRG1 (30/60/10/1) |

C. Preparation of Abrasive Articles Comprising a Grinding Supersize Coat

Binder precursor particle sample 55 were drop coated with a mesh sifter onto Abrasive Article E. The specific supersize weights can be found in Table 18. Next, the binder precursor particles were melted onto the abrasive article in an oven at 100–140° C., The samples were then irradiated (1 pass at 18.3 m/min) with one 400 W/cm "D" bulb.

TABLE 18

Abrasive Article Comprising a Supersize Coat

| Sample No. | Supersize Coat (g/m$^2$) |
|---|---|
| Sample 55 | 153 |

D. Evaluation of Abrasive Articles Comprising a Grinding Aid Supersize Coat

1. Swing Arm Flat Test

Abrasive article samples (17.8 cm diameter discs and 2.2 cm center diameter hole and 0.76 mm thickness) were attached to a backup pad and secured to the Swing Arm tester with a metal screw fastener. A 4130 steel workpiece (35 cm diameter) was weighed and secured to the Swing Arm tester with a metal fastener. The pressure was 4.0 kg. The endpoint of the test was 8 min at 350 rpm. The amount of steel removed was recorded.

As illustrated in Table 19, radiation curable binder precursor particles show utility as grinding aid supersize coats.

TABLE 19

Flat Testing of Sample 55 and Comparative X

| Sample No | Cut (g) | Ranking Relative to Comparative Abrasive Article X |
|---|---|---|
| Comparative W | 128 | 100 |
| Sample 55 | 134 | 105 |

Numerous characteristics, advantages, and embodiments of the invention have been described in detail in the foregoing description with reference to the accompanying drawings. However, the disclosure is illustrative only and the invention is not intended to be limited to the precise embodiments illustrated. Various changes and modifications may be made in the invention by one skilled in the art without departing from the scope or spirit of the invention.

What is claimed is:

1. A powder comprising a radiation curable component that is flowable at a temperature in the range from about 35° C. to about 180° C. containing at least one polyfunctional, radiation curable monomer and at least one polyfunctional, radiation curable macromolecule selected from an oligomer, a polymer, and a combination of at least one oligomer and at least one polymer, wherein the weight ratio of the monomer to the macromolecule is in the range from about 1:10 to about 10:1.

2. The powder of claim 1, wherein the radiation curable component comprises at least one radiation curable macromolecule including a plurality of radiation curable groups and a plurality of OH groups.

3. The powder of claim 1, wherein the radiation curable component comprises at least one radiation curable compound having a backbone containing an aromatic or heterocyclic moiety.

4. The powder of claim 1, wherein at least one of the monomer and macromolecule is a solid at temperatures below about 35° C.

5. The powder of claim 1, wherein the monomer and macromolecule are both solids at temperatures below about 35° C.

6. The powder of claim 1, wherein the monomer is a solid at temperatures below about 35° C. and the macromolecule is a liquid at least under ambient conditions.

7. The powder of claim 1, wherein the monomer is selected from a reaction product of a dicarboxylic acid and a reactant comprising hydroxy and radiation curable functionality, a reaction product of a hydroxyl functional isocyanurate and a carboxylic acid, a reaction product of a diisocyanate and a reactant comprising hydroxy and radiation curable functionality, a cyanate ester, a vinyl ether, and combinations thereof.

8. The powder of claim 1, wherein the oligomer is selected from the group consisting of a novolak phenolic oligomer functionalized with a plurality of radiation curable groups, a chain-extended bishenol A epoxy oligomer functionalized with a plurality of radiation curable groups, an epoxy functional oligomer, a novolak oligomer having cyanate ester functionality and combinations thereof.

9. The powder of claim 1, wherein the binder precursor comprises a radiation curable, monomer and a radiation curable, oligomer, wherein each of said monomer and oligomer independently has a melting point such that a blend of the monomer and oligomer is a solid at a temperature below about 35 C. and such that said blend is a melt at a temperature above about 35 C., wherein the weight ratio of the monomer to the oligomer is in the range from about 1:10 to 10:1.

10. The powder of claim 1, wherein the radiation curable component comprises a monomer of the formula:

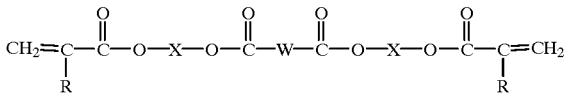

wherein W is a divalent aromatic moiety, X is divalent linking group, and R is selected from hydrogen or a lower alkyl group of 1 to 4 carbon atoms.

11. The powder of claim 1, wherein the radiation curable component comprises a monomer of the formula:

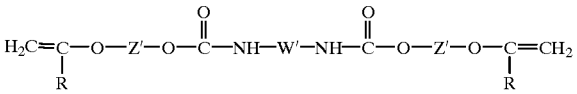

wherein W' is a divalent, aromatic moiety, Z' is a divalent linking group, and R is hydrogen or a lower alkyl group of 1 to 4 carbon atoms.

12. The powder of claim 1, wherein the radiation curable component comprises a monomer of the formula:

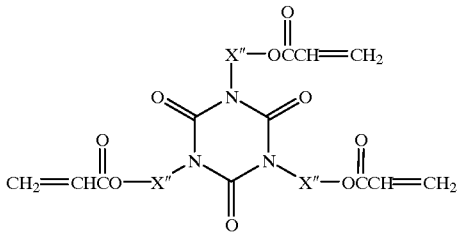

wherein X" is a divalent linking group.

13. The powder of claim 1, wherein the radiation curable component comprises an oligomer of the formula:

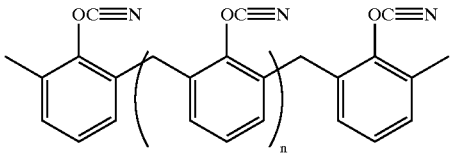

wherein n has an average value in the range from about 3 to about 20.

14. The powder of claim 1, wherein the radiation curable component comprises an oligomer of the formula:

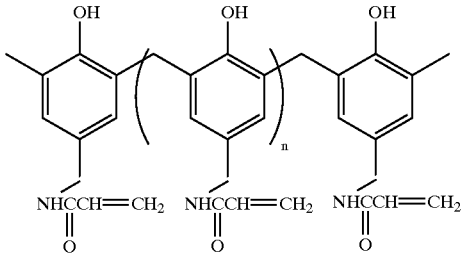

wherein n has an average value in the range from about 3 to about 20.

15. The powder of claim 1, wherein the radiation curable component comprises an oligomer of the formula:

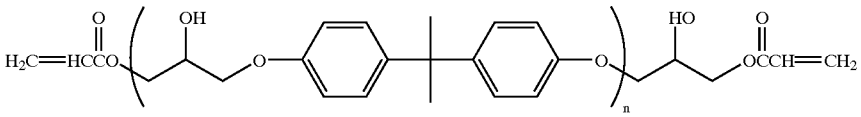

wherein n has a value such that the oligomer has a number average molecular weight in the range from about 800 to about 5000.

16. A powder, comprising a radiation curable component that is a solid at temperatures below about 35° C. and is fluidly flowable at a temperature in the range from about 35°

C. to about 180° C. and containing at least one monomer selected from the group consisting of (meth)acrylamide functional polyesters, (meth)acrylate-functional esters of aromatic dicarboxylic acids, (meth)acrylate-functional amides of aromatic dicarboxylic acids, and cyanate esters, and at least one macromolecule selected from the group consisting of cyanate ester oligomers, mixtures of cyanate esters and epoxy resins, and acrylamidomethyl novolaks.

* * * * *